US008220411B2

(12) United States Patent
Yoshino et al.

(10) Patent No.: US 8,220,411 B2
(45) Date of Patent: Jul. 17, 2012

(54) LIQUID APPLYING APPARATUS, METHOD OF CONTROLLING THE SAME, AND INK JET PRINTING APPARATUS

(75) Inventors: Hiroshi Yoshino, Kawasaki (JP); Hideaki Nagahara, Yokohama (JP); Tetsuyo Ohashi, Yokahama (JP); Takeshi Sekino, Yokohama (JP); Keisei Hakamata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 703 days.

(21) Appl. No.: 12/357,838

(22) Filed: Jan. 22, 2009

(65) Prior Publication Data

US 2009/0183678 A1 Jul. 23, 2009

(30) Foreign Application Priority Data

Jan. 23, 2008 (JP) ..... 2008-013068

(51) Int. Cl.

| | |
|---|---|
| ***B05C 1/06*** | (2006.01) |
| ***B05C 1/08*** | (2006.01) |
| ***B05C 11/00*** | (2006.01) |
| ***B05C 1/00*** | (2006.01) |
| ***B41J 2/01*** | (2006.01) |
| ***B41F 31/00*** | (2006.01) |
| ***B41F 1/46*** | (2006.01) |
| ***B41F 31/14*** | (2006.01) |
| ***B41K 1/38*** | (2006.01) |
| ***B41L 27/00*** | (2006.01) |
| ***B41L 27/16*** | (2006.01) |

(52) U.S. Cl. ..... 118/708; 118/259; 118/712; 118/249; 118/256; 118/261; 118/262; 118/600; 118/602; 347/101; 347/103; 101/335; 101/348

(58) Field of Classification Search ..... None
See application file for complete search history.

(56) References Cited

U.S. PATENT DOCUMENTS

| | | | | |
|---|---|---|---|---|
| 6,183,079 | B1 | 2/2001 | Meade et al. | |
| 7,395,778 | B2 | 7/2008 | Iwasaki et al. | |
| 7,588,639 | B2 * | 9/2009 | Iwasaki et al. | 118/300 |
| 2003/0141467 | A1 * | 7/2003 | Nishioka | 250/573 |
| 2005/0112278 | A1 * | 5/2005 | Obata et al. | 118/261 |
| 2006/0176325 | A1 * | 8/2006 | Seki et al. | 347/7 |
| 2007/0034152 | A1 * | 2/2007 | Nakagawa et al. | 118/679 |

(Continued)

FOREIGN PATENT DOCUMENTS

| | | |
|---|---|---|
| JP | 06-178957 | 6/1994 |

(Continued)

*Primary Examiner* — Dah-Wei Yuan
*Assistant Examiner* — Binu Thomas
(74) *Attorney, Agent, or Firm* — Fitzpatrick, Cella, Harper & Scinto

(57) ABSTRACT

An object of the present invention is to provide a liquid applying apparatus that enables the viscosity of a liquid to be applied and the condition of supply of the liquid to be detected using conventional mechanisms and without the need for a viscometer or the like, thus allowing prevention of improper application of the liquid to a medium and mitigation of wear of an applying roller or the like, the apparatus having an inexpensive configuration. Thus, according to the present invention, a driving load on an applying roller driving motor is detected when an applying roller is driven. If the driving load is equal to or more than a preset threshold, an operation of re-supplying the liquid is performed by a pump, or an operation of the roller driving motor is stopped.

8 Claims, 29 Drawing Sheets

U.S. PATENT DOCUMENTS

| | | | | |
|---|---|---|---|---|
| 2007/0035592 | A1* | 2/2007 | Oshio et al. | 347/84 |
| 2007/0035593 | A1* | 2/2007 | Iwasaki et al. | 347/85 |
| 2007/0126836 | A1* | 6/2007 | Masuyama et al. | 347/103 |
| 2008/0011225 | A1* | 1/2008 | McClure et al. | 118/244 |
| 2009/0183672 | A1 | 7/2009 | Nagahara et al. | |
| 2009/0194019 | A1* | 8/2009 | Hakamata et al. | 118/244 |
| 2010/0154706 | A1* | 6/2010 | Kondo | 118/258 |

FOREIGN PATENT DOCUMENTS

| | | |
|---|---|---|
| JP | 08-072227 | 3/1996 |
| JP | 2001-070858 | 3/2001 |
| JP | 2002-517341 | 6/2002 |
| JP | 2005-254229 | 9/2005 |
| JP | 2006-338100 | 12/2006 |

* cited by examiner

LIQUID APPLYING APPARATUS, METHOD OF CONTROLLING THE SAME, AND INK JET PRINTING APPARATUS

BACKGROUND OF THE INVENTION

1. Field of the Invention

The present invention relates to a liquid applying apparatus and a liquid applying mechanism that applies a liquid to a print medium to be printed by an ink jet printing apparatus, and specifically, to control of a liquid supply mechanism which is included in the liquid applying mechanism and which supplies the liquid.

2. Description of the Related Art

Spin coaters, roll coaters, bar coaters, and die coaters are known as methods of applying a liquid or a liquid material on common media. These applying methods are based on consecutive application of a liquid to relatively elongate applying media. Thus, for example, if applying media of a relatively small size are intermittently conveyed and then a liquid is applied to the applying media, application beads may disadvantageously be displaced at a application start or end position for each applying medium. Thus, for example, resulting coats may be prevented from being uniform.

A configuration described in Japanese Patent Laid-Open No. 2001-070858 is known to solve these problems. This configuration is based on a die coater method, and uses a rotating rod bar. A coating compound is ejected through an ejection slit to form a coat on the rod bar. As the rod bar rotates, the coat formed comes into contact with an applying medium and is thus transferred to the applying medium. In this case, when the coat formed by the rod bar is not transferred or applied to the applying medium, the rotation of the rod bar allows the coating compound to be returned to and collected in a head via a collecting slit. That is, while the coating compound is not being applied, the rod bar continues to rotate, with the coating compound forming the coat on the rod bar. Thus, even if the applying media are discontinuously supplied and the coating compound is discontinuously applied to the supplied applying media, uniform coats can be obtained.

In the field of ink jet printing apparatuses, some known apparatuses use liquid applying mechanisms. Japanese Patent Laid-Open No. 2002-517341 describes the use of a doctor blade that contacts a roller. A coating liquid is collected between the blade and the roller so that the coating liquid is applied to the roller as the roller rotates. As the roller rotates, the coating liquid applied to the roller is transferred and applied to a support conveyed between the roller and another roller. Japanese Patent Laid-Open No. H08-072227 (1996) discloses a mechanism in an ink jet printing apparatus which similarly applies a processing liquid that insolubilizes a dye, before printing. In Embodiment 1 in Japanese Patent Laid-Open No. H08-072227 (1996), the processing liquid in a refilling tank attaches to a rotating roller and is thus pumped out. At the same time, the pumped-out processing liquid is applied to a print sheet.

In all of the configurations described in Japanese Patent Laid-Open Nos. 2001-070858, 2002-517341, and H08-072227 (1996), as the rod bar or the roller rotates, the applying liquid is applied or supplied to a surface of the bar or the roller. Consequently, the portion of the bar or roller to which the applying liquid is applied or supplied is open to or communicates with atmosphere. Thus, disadvantageously, the applying liquid may be evaporated, or when the posture of the apparatus is changed, the applying liquid may leak.

In particular, for the ink jet printing apparatus such as a printer, when the apparatus is miniaturized, applying the applying mechanisms described in Japanese Patent Laid-Open Nos. 2001-070858, 2002-517341, and H08-072227 (1996) to the apparatus is difficult in view of the leakage of the liquid which may occur when the posture of the apparatus is changed during transportation.

In contrast, Japanese Patent Laid-Open No. 2005-254229 discloses a configuration that seals the portion of the roller to which the applying liquid is applied or supplied. The configuration uses an ink chamber with an integral member located along a peripheral surface of the roller. The ink chamber is allowed to abut against the peripheral surface of the roller to form a liquid chamber between the ink chamber and the roller. Then, the roller is rotated to apply or supply the applying liquid in the liquid chamber to the roller.

Furthermore, as means for supplying the applying liquid to the mechanism applying the applying liquid based on a closed space as disclosed in Japanese Patent Laid-Open No. 2005-254229, two channels are used to couple the applying mechanism applying the applying liquid to applying liquid storing means for storing the applying liquid to form a circuit through which the applying liquid is circulated using a pump. As a specific example, Japanese Patent Laid-Open No. 2005-254229 discloses a configuration in which the pump is located on a downstream side of the applying mechanism in the circuit for circulation. This configuration sets the internal pressure of the applying mechanism to at most the atmospheric pressure. As a result, the possible leakage of the liquid from the applying mechanism can be prevented.

Moreover, according to the Japanese Patent Laid-Open No. 2005-254229, an on-off valve that switches between communication with the atmosphere and communication with the applying liquid storing means is located on an upstream side of a liquid applying space. Thus, the applying liquid in liquid holding section can be collected into the applying liquid storing means.

The applying liquid and air entrained in the applying liquid during an applying operation and air sucked during a collecting operation flow from the applying means into the applying liquid storing means via the channels. The applying liquid with no air entrained therein needs to be fed from the applying liquid storing means to the applying means. However, in the applying liquid storing means, the inflow air and liquid are separated from each other in a vertical direction. The liquid is then fed to the channel communicating with the liquid applying means, through an opening located in the vicinity of the bottom of the liquid applying means. Thus, air can be prevented from being entrained in the liquid supplied to the liquid holding section. Furthermore, to prevent the air flowing into the liquid storing means from being built up to increase the internal pressure of the applying liquid storing means, the applying liquid storing means includes a mechanism that enables communication with the atmosphere. The mechanism enabling the communication with the atmosphere is composed of an atmosphere communication port and an atmosphere communication valve that opens and closes the atmosphere communication port. This enables the liquid storing means to communicate with the atmosphere during the circulation and to be shut off from the atmosphere while the apparatus is not in use.

Thus, the liquid applying apparatus disclosed in Japanese Patent Laid-Open No. 2005-254229 can prevent the possible leakage of the applying liquid while the apparatus is not in use, for example, during transportation, based on the operation of collecting the liquid from the liquid holding section as well as the atmosphere communication valve, which enables the liquid storing means to be shut off from the atmosphere. The collecting operation and the mechanism shutting off the liquid storing means from the atmosphere enable prevention of the possible leakage of the applying liquid while the apparatus is not in use, for example, during transportation.

Additionally, in Japanese Patent Laid-Open No. 2006-338100, the mechanism provided in the applying liquid storing means and communicating with the atmosphere is positioned almost at the center of gravity of the applying liquid storing means. Thus, even with a change in the posture of the apparatus that is not in use or a change in environments such as the temperature of outside air, the possible leakage of the applying liquid can be prevented.

In contrast, Japanese Patent Laid-Open No. H06-178957 (1994) proposes that viscosity measuring means and viscosity control means for the applying liquid be provided to appropriately control the viscosity of the applying liquid.

However, the techniques disclosed in the above described patent documents pose the following problems.

The techniques described in Japanese Patent Laid-Open Nos. 2001-070858, 2002-517341, H08-072227 (1996), 2005-254229, and 2006-338100 fail to detect the condition of the applying liquid, for example, thickening or solidification of the liquid resulting from a temporal or environmental change, or a failure to supply the liquid to the applying mechanism. Thus, the applying operation may be performed with the applying liquid thickened or solidified or with the liquid failing to be sufficiently supplied to the applying mechanism. As a result, the applying liquid may be improperly applied to the medium. Furthermore, if the applying operation is continuously performed with the liquid failing to be supplied to the applying mechanism, the applying roller or related components contacting the applying roller may be excessively worn away. As a result, replacement of parts of the apparatus and maintenance of the apparatus may require much time and cost.

To deal with this problem, a viscometer for the applying liquid may be provided as disclosed in Japanese Patent Laid-Open No. H06-178957 (1994) so as to perform control such that, for example, the apparatus is stopped if the applying liquid is too viscous. However, this poses a new problem; the addition of viscosity sensing means and the viscosity control means increases the costs of the apparatus.

SUMMARY OF THE INVENTION

An object of the present invention is to provide a liquid applying apparatus that enables the viscosity of a liquid to be applied and the condition of supply of the liquid to be detected using conventional mechanisms and without the need for a viscometer or the like, thus allowing prevention of improper application of the liquid to a medium and mitigation of wear of an applying roller or the like, the apparatus having an inexpensive configuration.

A first aspect of the present invention provides a liquid supplying apparatus including an applying mechanism that applies a liquid supplied to a liquid holding section to a medium through rotation of an applying roller, a roller driving unit that rotates the applying roller, and a liquid supplying unit capable of supplying the liquid to the liquid holding section, wherein the apparatus further includes load detecting unit that detects a driving load on the roller driving unit and a determining unit that determines a condition of the liquid based on the driving load detected by the load detecting unit.

A second aspect of the present invention provides a method of controlling a liquid supplying apparatus including an applying mechanism that applies a liquid supplied to a liquid holding section to a medium through rotation of an applying roller, a roller driving unit that rotates the applying roller, and a liquid supplying unit capable of supplying the liquid to the liquid holding section, the method including a supply step of allowing the liquid supply unit to perform a liquid supply operation so as to supply a predetermined amount of liquid to the liquid holding section before an operation of applying the liquid to the medium, a load detecting step of detecting a driving load on the roller driving unit, and a re-supply step of, if the driving load on the roller driving unit detected in the load detecting step is equal to or more than a preset threshold, allowing the liquid supply unit to perform an operation of re-supplying the liquid.

A third aspect of the present invention provides an ink jet printing apparatus including the liquid applying apparatus and a printing unit that ejects ink from a print head to a medium with a liquid applied thereto to print an image on the medium.

According to the present invention, even if the liquid to be applied is thickened or solidified or the applying liquid is improperly supplied to the liquid holding section, this can be detected without using a viscometer or the like. This enables prevention of improper application of the liquid and mitigation of damage to an applying roller. Consequently, the time, effort, and money required for maintenance of the apparatus can be reduced.

Further features of the present invention will become apparent from the following description of exemplary embodiments (with reference to the attached drawings).

DESCRIPTION OF THE EMBODIMENTS

Embodiments of the present invention will be described below in detail with reference to the drawings.

1. Embodiment of the Liquid Applying Apparatus 1-1. General Configuration

Figure 1:
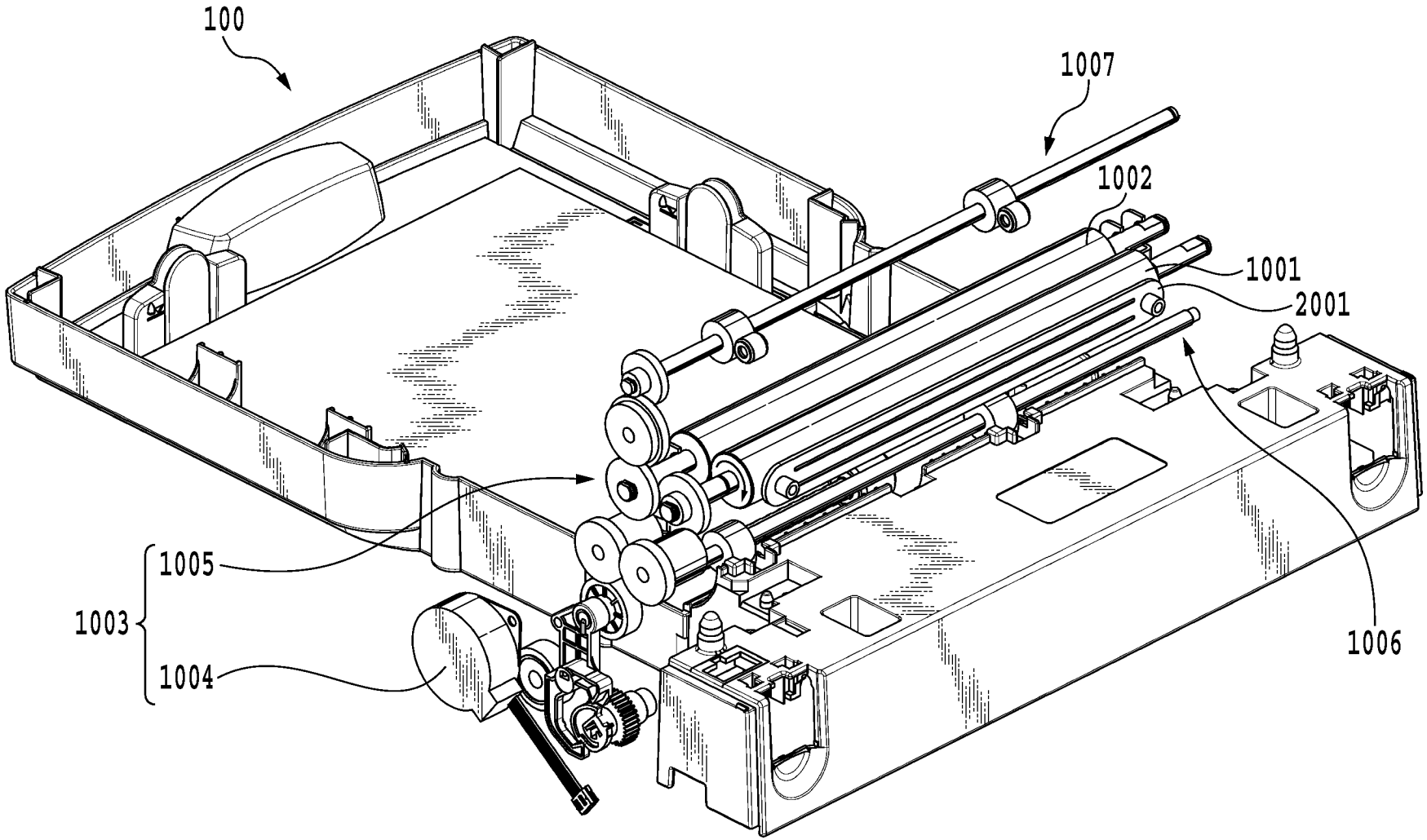
FIG. 1 is a perspective view generally showing the configuration of an embodiment according to a liquid applying apparatus of the present invention.

FIG. 1 is a perspective view generally showing the configuration of an embodiment according to a liquid applying apparatus 100 of the present invention.

The liquid applying apparatus shown in FIG. 1 roughly has liquid applying unit for applying a predetermined liquid (applying liquid) to a medium to which a liquid is to be applied (the medium will be also referred to as a applying medium in the description below) and liquid supplying unit capable of supplying an applying liquid to the liquid applying unit.

The liquid applying unit has a cylindrical applying roller 1001, a cylindrical counter roller (medium supporting member) 1002 placed opposite the applying roller 1001, and a roller driving mechanism 1003 that drives the applying roller 1001. The roller driving mechanism 1003 comprises a roller driving motor 1004 and a transmission mechanism 1005 which transmits the driving force of the roller driving motor 1004 to the applying roller 1001 and which has a gear train and the like.

The liquid supplying unit has, for example, a liquid holding member 2001 that holds the applying liquid between the liquid holding member 2001 and a peripheral surface of the applying roller 1001, and a liquid channel 3000 (see FIG. 11) described later and through which the liquid is supplied to the liquid holding member 2001. The applying roller 1001 and the counter roller 1002 are rotatively movably supported by respective shafts which are parallel to each other and each of which has opposite ends rotatively movably attached to a frame (not shown). Further, the liquid holding member 2001 extends almost all along the applying roller 1001 in a longitudinal direction. The liquid holding member 2001 is movably attached to the frame via a mechanism that enables the liquid holding member 2001 to contact with and separate from the peripheral surface of the applying roller 1001.

The liquid applying apparatus according to the present embodiment further comprises an applying medium supplying mechanism 1006 which consists of a pickup roller or the like to convey an applying medium to a nip portion between the applying roller 1001 and the counter roller 1002. Further, in a conveying path for applying media, a sheet discharging mechanism 1007 consisting of a sheet discharging roller or the like is provided downstream of the applying roller 1001 and the counter roller 1002 to convey a applying medium on which the application liquid has been applied, to a sheet discharging section (not shown). Like the applying roller and the like, the sheet supplying mechanism and the sheet discharging mechanism are operated under the driving force of the driving motor 1004 transmitted via the transmission mechanism 1005.

The application liquid used in the present embodiment is intended to facilitate the coagulation of pigments when printing has been carried out using inks including the pigments as color materials.

An example of the components of the application liquid is shown below.

Tetrahydrate of calcium nitrate: 10%
Glycerin: 42%
Surface active agent: 1%
Water: remaining amount The application liquid has a viscosity of 5 to 6 cp (centipoise) at 25° C.

In applications of the present invention, of course, the application liquid is not limited to the one described above. For example, a liquid including a component which insolubilizes or coagulate a dye may be used as another application liquid. A liquid containing components to restrain a curl (phenomenon in which a medium becomes curve shape) of the application medium may be used.

If water is used as a liquid to be applied, the slidability of the abutting portion between the applying roller and the liquid holding member according to the present invention is improved by containing a component that reduces surface tension in the liquid. In the above example of the components of the liquid to be applied, the glycerin and the surface active agent are components that reduce the surface tension of water.

Now, components of the sections constituting the liquid applying apparatus described above in brief will be described in further detail.

1-2. Liquid Applying Mechanism

Figure 2:
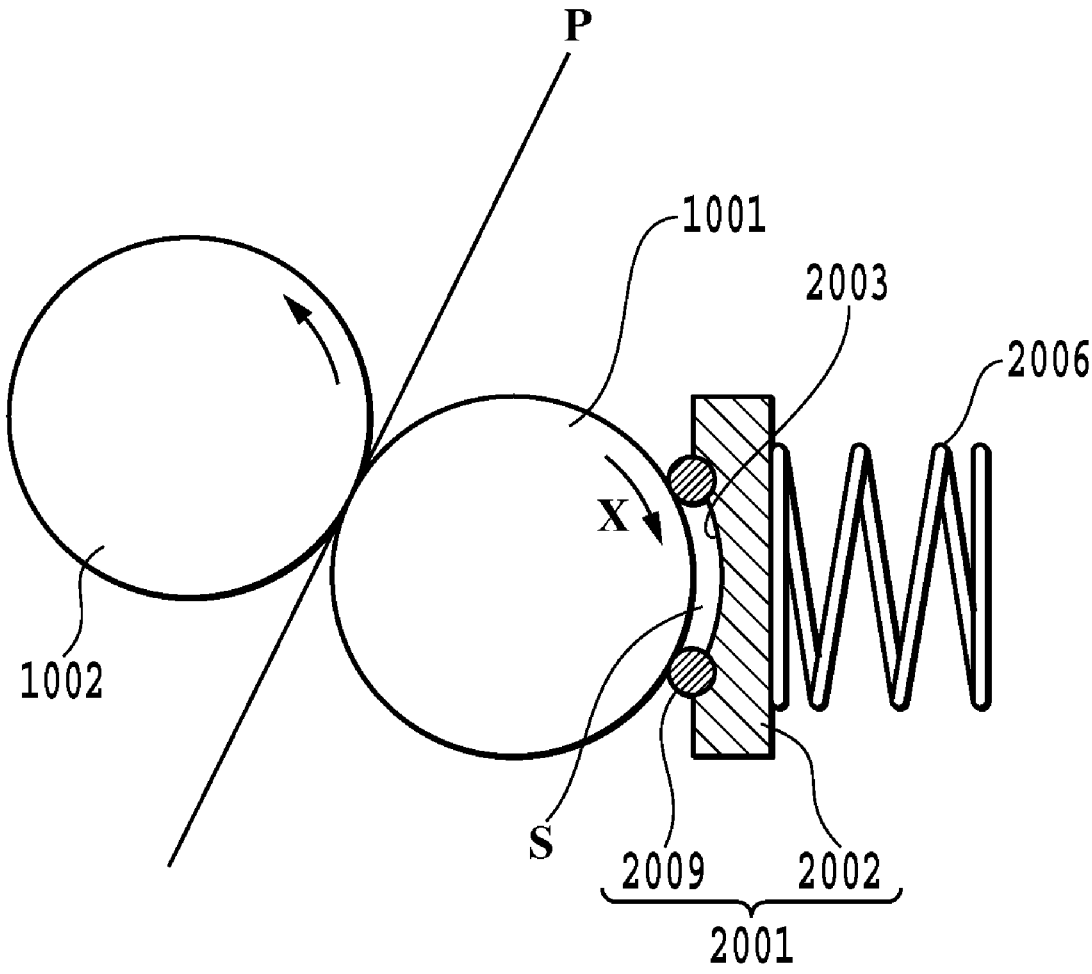
FIG. 2 is a schematic vertical side view showing an example of the arrangement of a applying roller, a counter roller, a liquid holding member, and the like which are shown in FIG. 1.

FIG. 2 is a vertical side view showing an example of arrangement of the applying roller 1001, the counter roller 1002, the liquid holding member 2001, and the like.

The counter roller 1002 is urged toward a peripheral surface of the applying roller 1001 by a spring member 2006. Rotating the applying roller 1001 clockwise in the figure allows an applying medium P to which the applying liquid is to be applied to be sandwiched between the rollers 1002 and 1001. Furthermore, the applying medium P can be conveyed in the direction of an arrow in the figure.

In the present embodiment, the application roller 1001 is formed of silicone with a rubber hardness of 40 degrees, and has a surface roughness Ra of 1.6 μm and a diameter of 23.169 mm. The counter roller 1002 is formed of iron and has a diameter of 14 mm.

Further, when urged and abutted against the peripheral surface of the applying roller 1001 under the urging force of a spring member (pressing member) 2006, the liquid holding member 2001 forms an elongate liquid holding space S extending all over an area applied the liquid by the applying roller 1001. The application liquid from a liquid channel 3000, described later, is supplied to the interior of the liquid holding space S via the liquid holding member 2001. In this case, since the liquid holding member 2001 is configured as described below, the application liquid can be prevented from or reduce inadvertently leaking from the liquid holding space S to the exterior while the applying roller 1001 is stopped.

FIGS. 3 to 8 show the configuration of the liquid holding member 2001.

Figure 3:
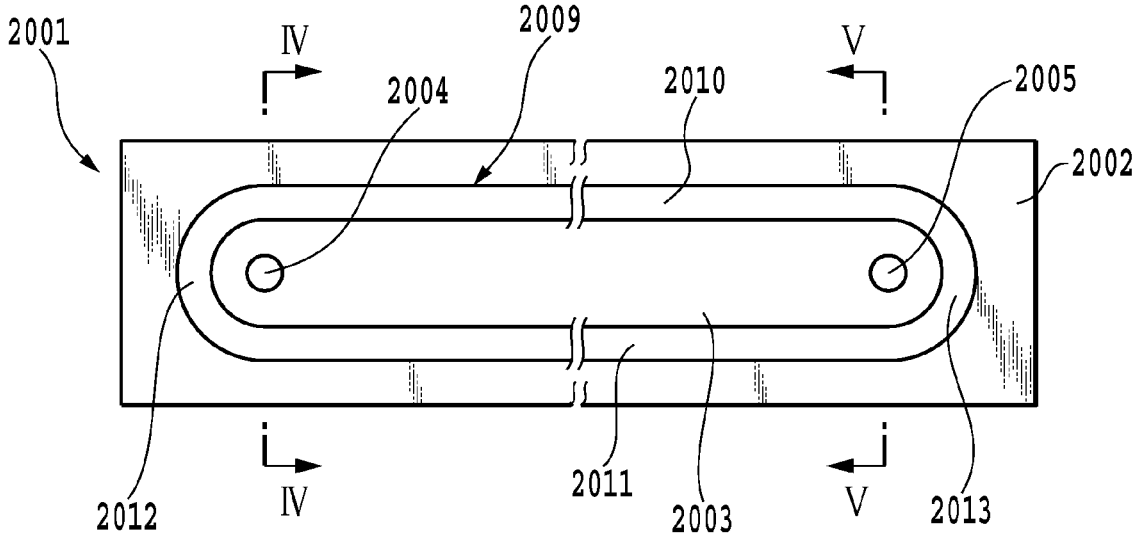
FIG. 3 is a front view of the liquid holding member shown in FIGS. 1 and 2.

As shown in FIG. 3, the liquid holding member 2001 has a space forming base material 2002 and an annular abutting member 2009 located on one surface of the space forming base material 2002. A concave portion 2003 is formed in a central portion of the space forming base material 2002 along a longitudinal direction thereof. A straight portion of the abutting member 2009 is secured to the concave portion 2003 along an upper edge thereof. A circumferential portion of the abutting member 2009 is secured to extend from the upper edge through a bottom portion to an opposite, upper edge of the concave portion 2003. Thus, when the abutting portion 2009 of the liquid holding member 2001 abuts against the applying roller 1001, abutment along the peripheral shape of the applying roller can be achieved by uniform pressure.

As described above, in the liquid holding member according to this embodiment, the abutting member 2009, formed integrally and seamlessly, is continuously abutted without a gap against the outer peripheral surface of the applying roller 1001 under the urging force of the spring member 2006. As a result, the liquid holding space S is substantially closed by the abutting member 2009, one surface of the space forming base material 2002, and the outer peripheral surface of the applying roller 1001. The applying liquid is held in this space. Then, when the rotation of the applying roller 1001 is stopped, the abutting member 2009 and the outer peripheral surface of the applying roller 1001 maintain a liquid tight state. The liquid can be reliably prevented from leaking to the exterior. On the other hand, when the applying roller 1001 rotates, the applying liquid passes through between the outer peripheral surface of the applying roller 1001 and the abutting member 2009. The applying liquid then attaches to the outer peripheral surface of the applying roller in the form of a layer. Here, the tight contact maintained between the outer peripheral surface of the applying roller 1001 and the abutting member 2009 while the applying roller 1001 is stopped unit that the liquid in the liquid holding space is prevented from flowing to the exterior, as described above. In this case, the abutting state of the abutting member 1009 includes, in addition to a state in which the abutting member 1009 abuts against the outer peripheral surface of the applying roller 1001, a state in which the abutting member 1009 abuts against the outer peripheral surface via a liquid film formed by a capillary force.

Figure 8:
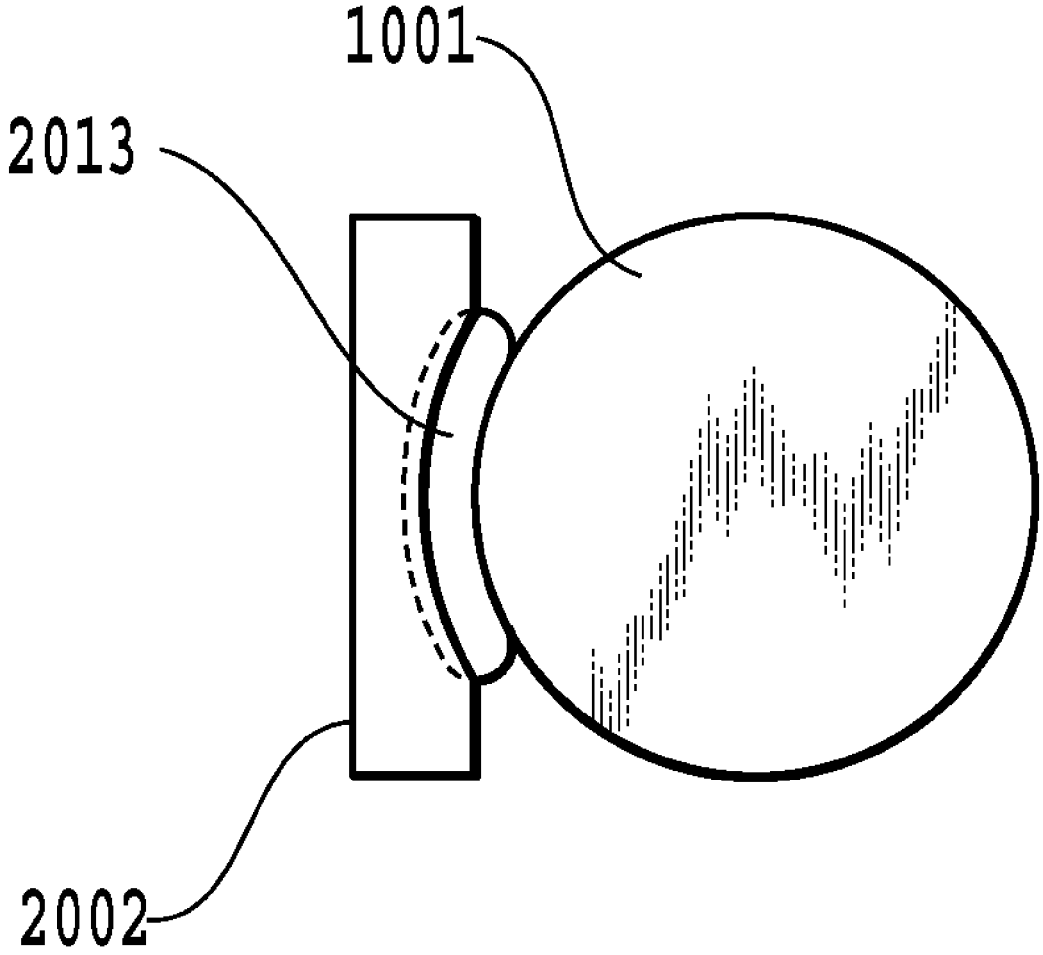
FIG. 8 is a right side view showing how the abutting portion of the liquid applying member shown in FIG. 3 is abutted against the liquid applying roller.
Figure 9:
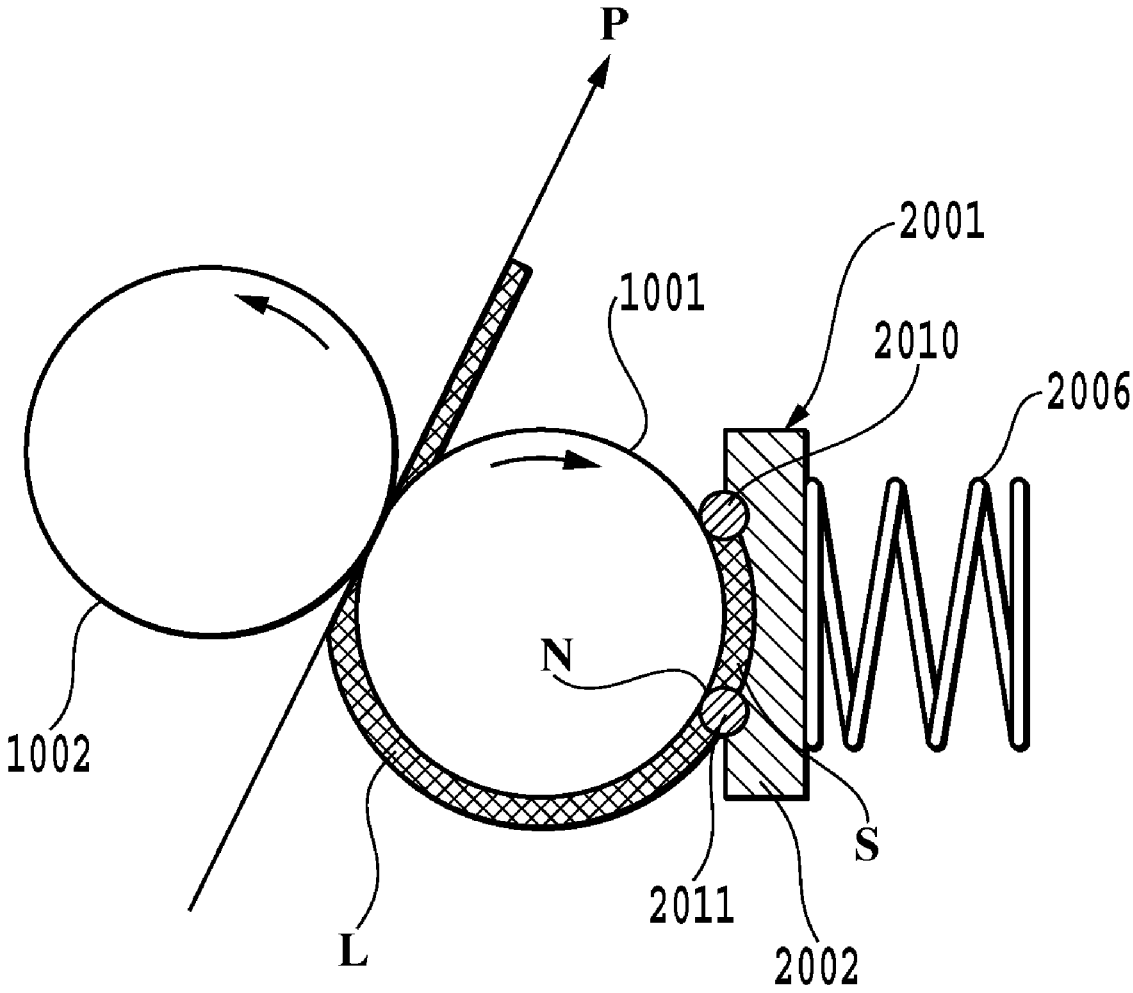
FIG. 9 is a vertical sectional view showing how a applying liquid is filled into a liquid holding space formed by the liquid holding member and the applying roller and how a liquid is applied to a applying medium by the rotation of the applying roller.

Furthermore, laterally opposite sides of abutting member 2009 in the longitudinal direction appear gently curved as viewed from any directions, that is, in all of a front view (FIG. 3), a plan view (FIG. 6), and a side view (FIGS. 7 and 8), as shown in FIGS. 3 to 8. Thus, even when the abutting member 2009 is forced to abut against the applying roller 1001 under a relatively strong pressing force, the abutting member 2009 as a whole is elastically deformed substantially uniformly and is prevented from being locally significantly distorted. Consequently, as shown in FIGS. 8 and 9, the abutting member 2009 abuts continuously against the outer peripheral surface of the applying roller 1001 without a gap, enabling formation of the substantially closed space.

Figure 4:
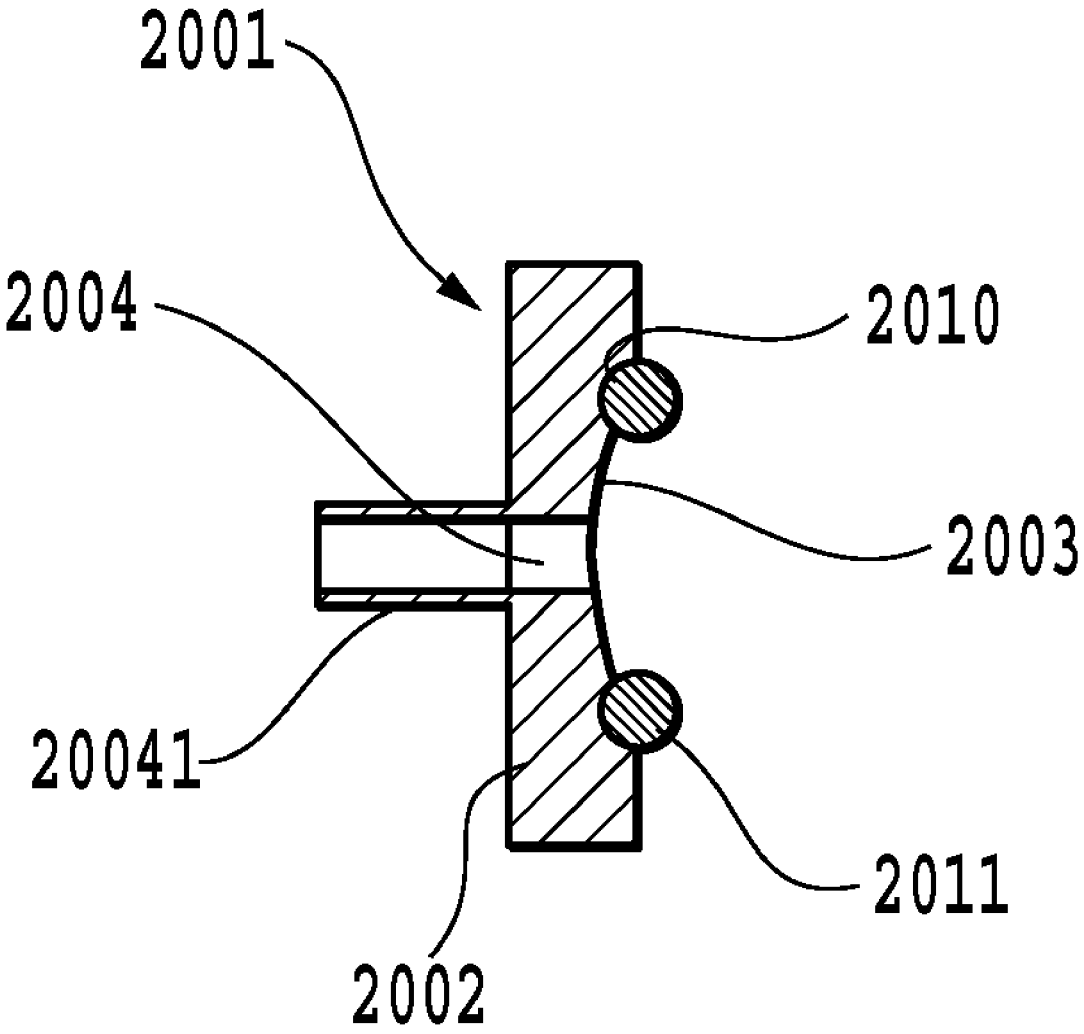
FIG. 4 is an end view showing an end surface of the liquid holding member shown in FIG. 3, the view taken along line IV-IV in FIG. 3.
Figure 5:
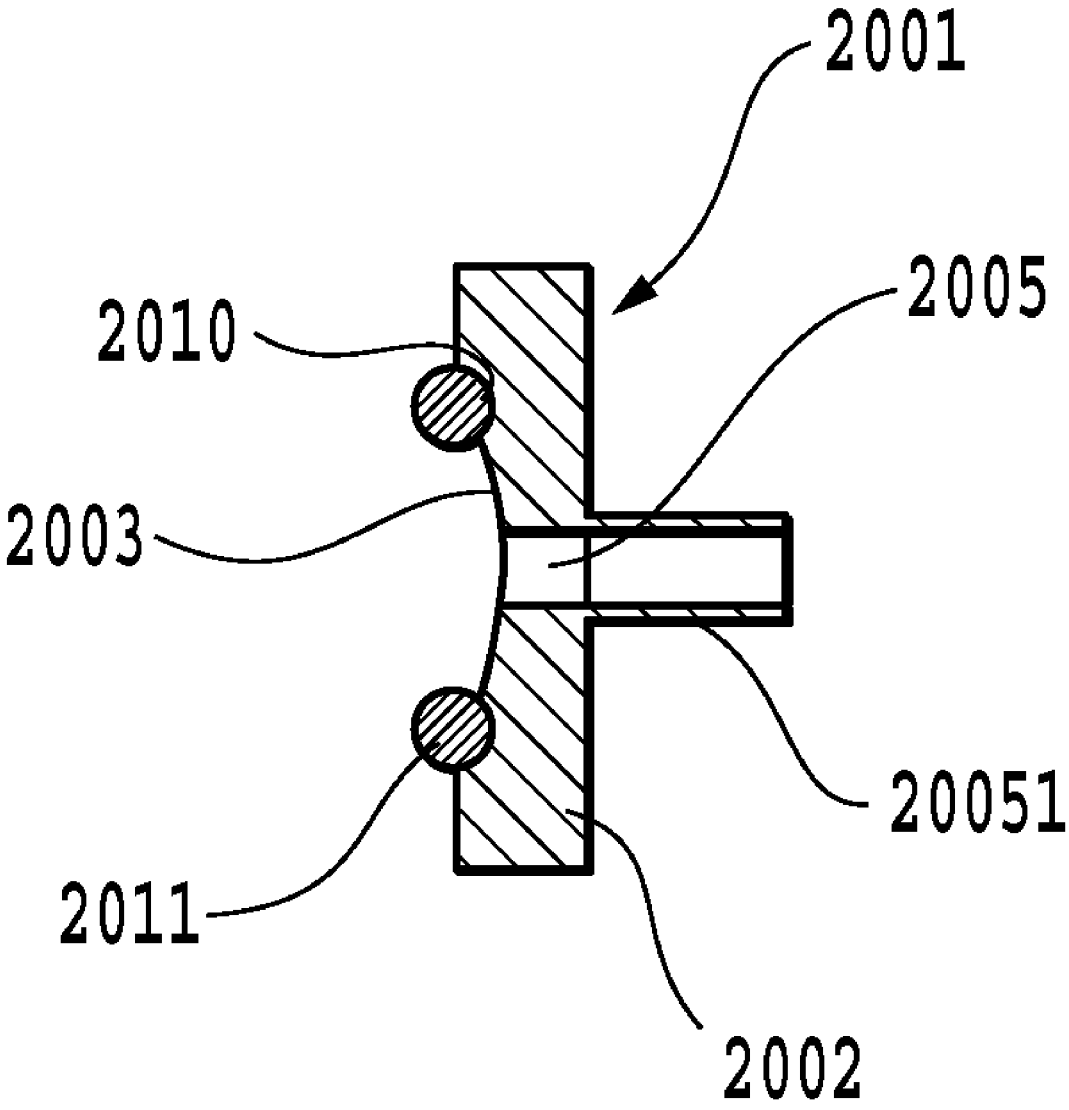
FIG. 5 is an end view showing the end surface of the liquid holding member shown in FIG. 3, the view taken along line V-V in FIG. 3.
Figure 6:
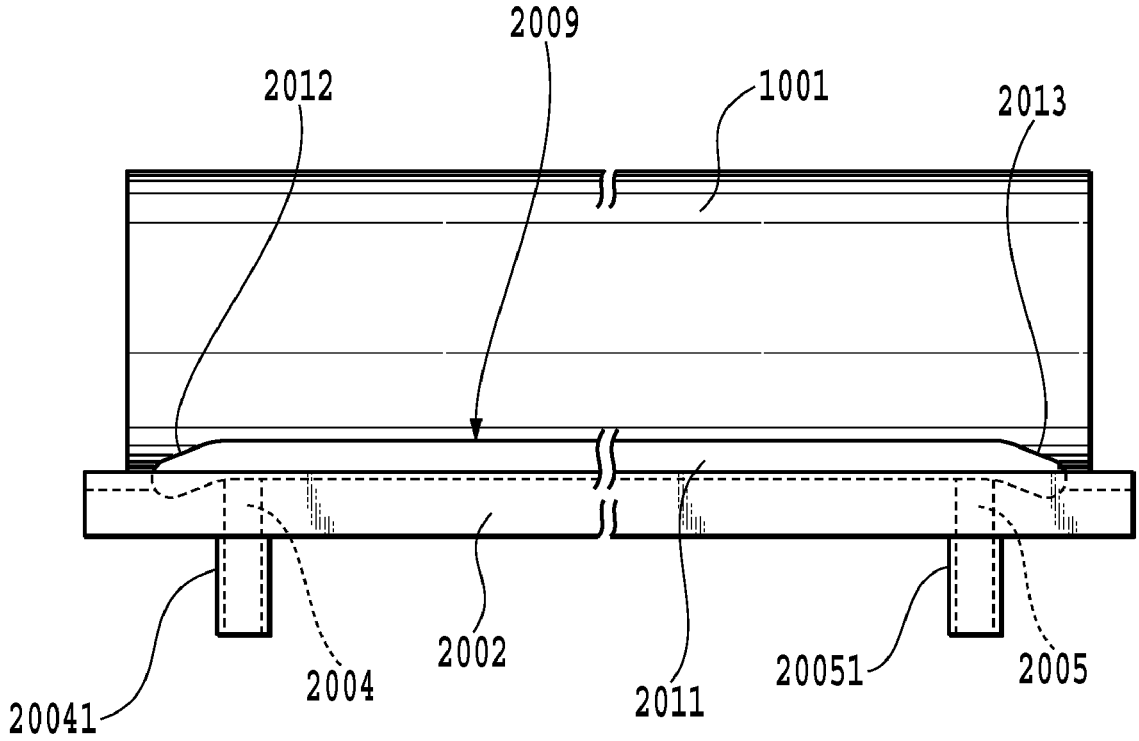
FIG. 6 is a plan view of the liquid holding member shown in FIG. 3.
Figure 7:
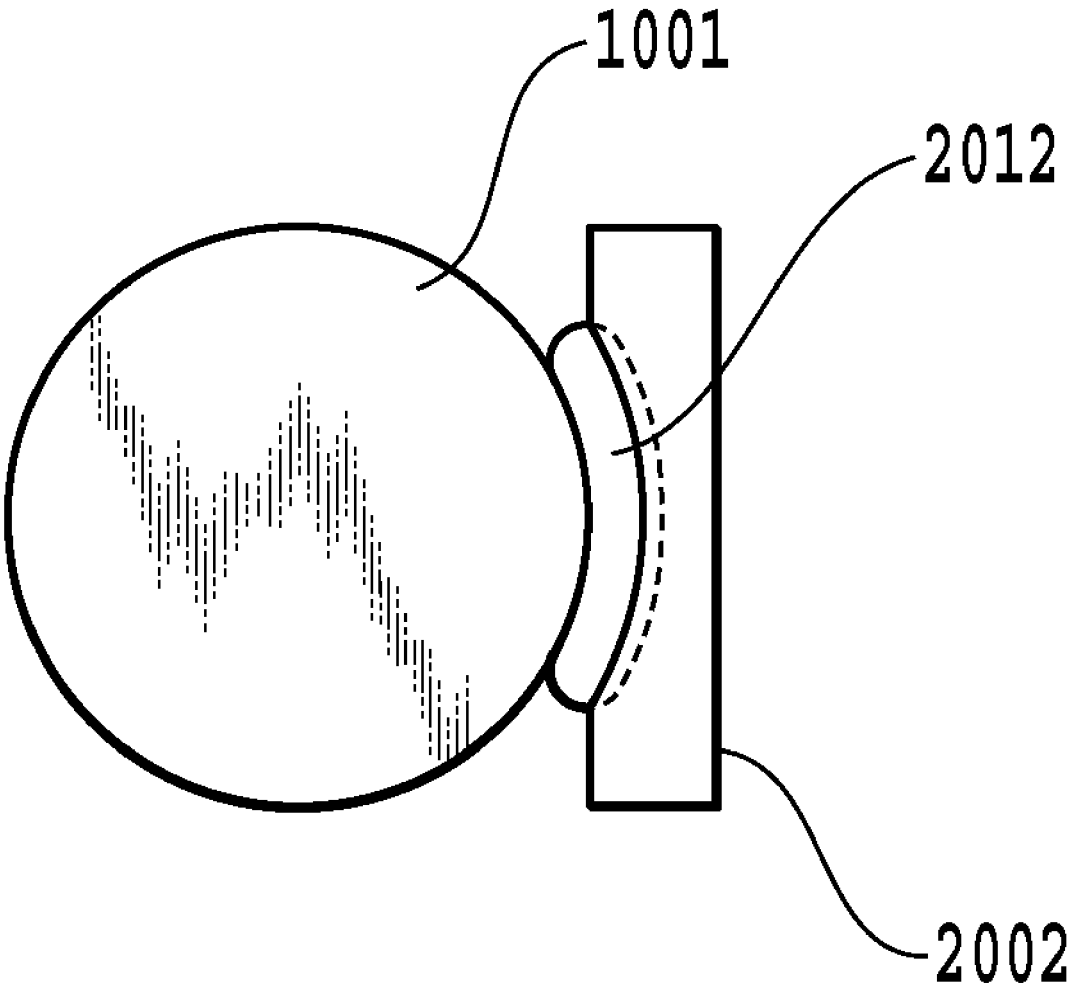
FIG. 7 is a left side view showing how an abutting portion of the liquid applying member shown in FIG. 3 is abutted against a liquid applying roller.

On the other hand, as shown in FIGS. 3 to 5, a liquid supplying port 2004 and a liquid collecting port 2005 are formed in an area of the space forming base material 2002 which is surrounded by the abutting member 2009; the liquid supplying port 2004 and the liquid collecting port 2005 have holes penetrating the space forming base material 2002. The liquid supplying port 2004 and the liquid collecting port 2005 are communicating with cylindrical connecting portions 20041 and 20051 projected from a back surface of the space forming base material. Further, the connecting portions 20041 and 20051 are connected to a liquid channel 3000 described later. In this embodiment, the liquid supplying port 2004 is formed near one end of an area surrounded by the abutting member 2009 (the left end in FIG. 3), while the liquid collecting port 2005 is formed near the other end of the same area (the right end in FIG. 3). The liquid supplying port 2004 is used to supply the application liquid provided through the liquid channel 3000, to the liquid holding space S. The liquid collecting port 2005 is used to allow the liquid in the liquid holding space S to flow out to the liquid channel 3000. The supply and flow out of the application liquid allows the liquid to flow from the left end to right end of the liquid holding space S.

1.3. Application Liquid Channel and Liquid Refill Unit

Figure 11:
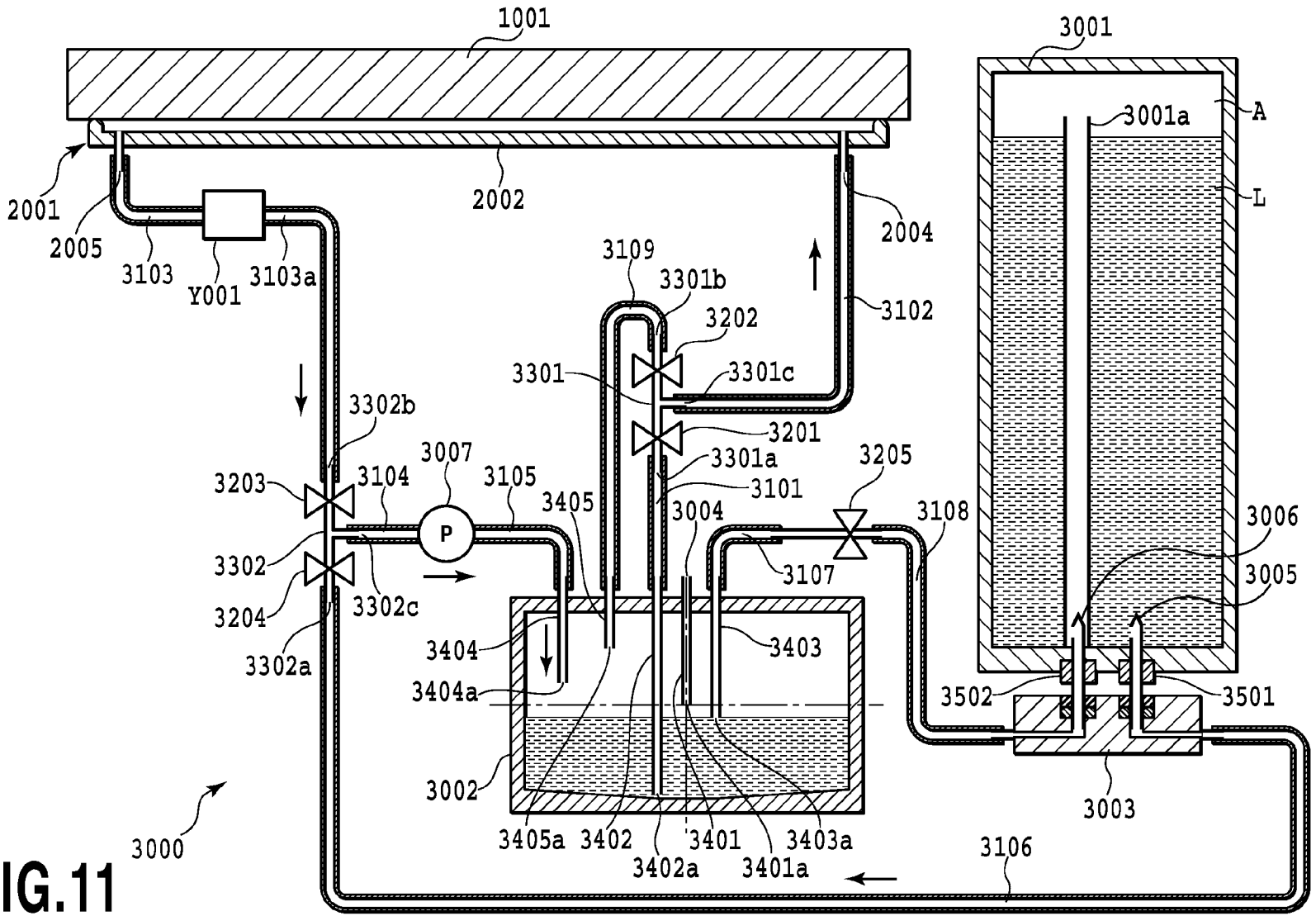
FIG. 11 is a perspective view showing a general configuration of an embodiment of a liquid applying apparatus according to the present invention.

FIG. 11 is a diagram schematically showing the a liquid channel 3000 of this embodiment, buffer tank 3002 for storing application liquid which is supplied to the liquid holding member 2001 and replacement tank 3001 for refilling the application liquid which is supplied to the buffer tank. The liquid channel 3000 comprises a first channel (application channel) which couples the liquid supply port 2004 in the space forming base material 2002, constituting the liquid holding member 2001, to a buffer tank 3002 storing the application liquid. The first channel includes a tube 3101, a first T-shaped pipe 3301 and tube 3102.

Furthermore, the liquid channel 3000 includes a second channel (collecting channel) that couples a downstream side of the space forming base material 2002, that is, a liquid collecting port 2005, to the buffer tank 3002. The second channel includes tubes 3103 and 3103*a*, a liquid sensor (liquid sensing unit) Y001, a second T-shaped pipe 3302, and tubes 3104 and 3105. Five coupling pipes (pipe members) 3401, 3402, 3403, 3404, and 3405 that allow the interior of the buffer tank to communicate with the exterior are fixed to one surface (top surface) of the buffer tank 3002. One of the coupling pipes, the coupling pipe 3401, serves as an atmosphere communication pipe constituting an atmosphere communication passage that allows the interior of the buffer tank 3002 to communicate with the exterior.

The tubes 3101 and 3102, constituting the first channel, couples the communication pipe 3402, provided in the buffer tank 3002, to the liquid supply port 2004, via the first T-shaped pipe 3301, including ports 3301*a*, 3301*b*, and 3301*c* located in respective directions. That is, the tube 3101 couples the coupling port 3301*a* of the first T-shaped pipe 3301 to the communication pipe 3402, provided in the buffer tank 3002. Furthermore, the tube 3102 couples the communication port 3301*c* of the first T-shaped pipe 3301 to the liquid supply port 2004.

A first shut-off valve 3201 is provided between a junction of the first T-shaped pipe and the coupling port 3301*a* to enable the junction and the coupling port 3301*a* to be switched between a communication state and a shut-off state. A second shut-off valve 3202 is provided between a junction of the first T-shaped pipe 3301 and the communication port 3301*b* to enable the junction and the communication port 3301*b* to be switched between the communication state and the shut-off state. The communication port 3301*b* of the first T-shaped pipe 3301 is coupled to a coupling pipe 3405 provided in the buffer tank, via the tube 3102, which is bent in U shape. Thus, the communication port 3301*b* of the first T-shaped pipe 3301 can communicate with the atmosphere via the second shut-off valve 3202, the tube 3109, the coupling pipe 3405, the interior space of the buffer tank 3002, and the atmosphere communication pipe 3401.

As described above, in the first channel, a combination of the communication state and shut-off state established by the first shut-off valve 3201 and the second shut-off valve 3202 allows the tube 3102 to communicate selectively with one of the applying liquid in the buffer tank 3002 and the atmosphere.

On the other hand, a pump 3007 forcing the applying liquid and air to flow through the liquid channel 3000 toward the buffer tank 3002 is connected to the tube 3103, second T-shaped pipe 3302, tube 3104, and tube 3105, constituting the second channel. One end of the tube 3104 is coupled to a side (hereinafter also referred to as the "upstream side of the pump") of the pump 3007 into which the applying liquid flows. The tube 3105 is coupled to a side (hereinafter also referred to as the "downstream side of the pump") of the pump 3007 out of which the applying liquid flows. The tube 3105 couples the communication pipe 3404, provided in the buffer tank 3002, to the pump 3007. The tube 3104 couples the pump 3007 to the communication port 3302*c* of the second T-shaped channel 3302. The tube 3103 couples the liquid collecting port 2005 to the communication port 3302*b* of the second T-shaped pipe 3302. Furthermore, a third shut-off valve 3203 is coupled between the junction and communication port 3302*b* of the second T-shaped pipe 3302. A fourth shut-off valve 3204 is coupled between the junction and communication port 3302*a* of the second T-shaped pipe 3302.

Figure 12:
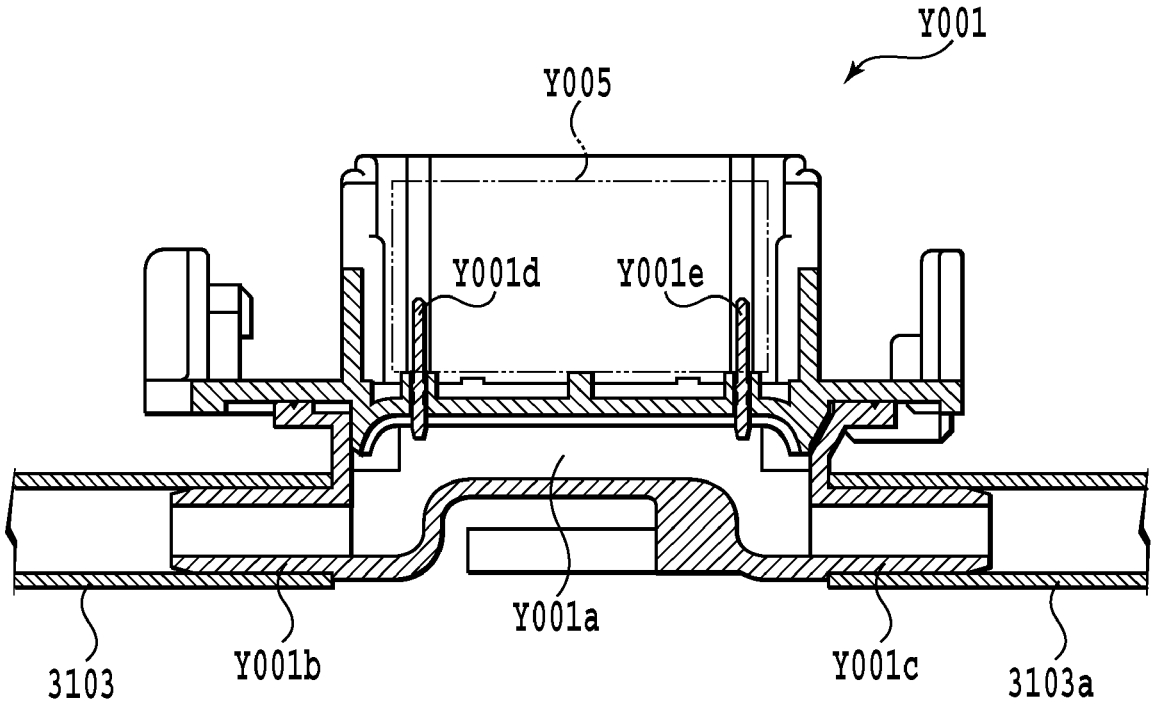
FIG. 12 is a schematic diagram showing a configuration of a liquid sensor according to the embodiment of the present invention.

The liquid sensor Y001, connected between the tubes 3103 and 3103*a* in the second channel, is provided to determine whether or not the applying liquid is present in the space forming base material 2002. The liquid sensor Y001 has a structure described below. FIG. 12 shows a schematic sectional view of the liquid sensor Y001.

The tubes 3103 and 3103*a* are connected to joint portions Y001*b* and Y001*c*, respectively, of the liquid sensor Y001. A channel Y001*a* allowing the joint portions Y001*b* and Y001*c* to communicate with each other is formed inside the liquid sensor Y001. Electrode members Y001*d* and Y001*e* formed of metal project into the channel Y001*a*. A connector Y005 is connected to each of the electrode members Y001*d* and Y001*e* and electrically connected to a liquid detecting circuit Y006 via predetermined connection unit. The liquid detecting circuit Y006 is connected to a control section 4000 described below. The liquid sensor Y001 energizes the electrode members Y001*d* and Y001*e* to sense whether or not the applying liquid is present in the channel Y001*a*. That is, if the applying liquid is present in the channel Y001*a*, the electrodes communicate electrically with each other via the applying liquid. In contrast, if no applying liquid is present in the channel Y001*a*, the electrodes are electrically shut off from each other. Then, the liquid sensing circuit Y006 transmits a signal corresponding to the electric communication state or electric shut-off state of the electrodes, to the control section 4000.

In the first and second channels, by opening the shut-off valves 3201 and 3203, closing the shut-off valves 3202 and 3204, and driving the pump 3007, the applying liquid in the buffer tank 3002 can be circulatively supplied to the space forming base material 2002.

The liquid channel 3000 further includes a third channel (refilling channel) coupling the second channel to a replaceable replacement tank 3001 in which the applying liquid is stored, and a fourth channel coupling the buffer tank 3002 to the replacement tank 3001.

One end of a tube 3106 included in the third channel is coupled to the replacement tank 3001 via an injection needle-like first coupling port 3005 and a pedestal 3003 constituting a coupling channel. That is, the injection needle-like first coupling port 3005 pierces rubber 3501 provided at the bottom of the replacement tank 3001 to couple the tube 3106 to the replacement tank 3001. The other end of the tube 3106 is coupled to the coupling port 3302*a*of the second T-shaped channel 3302. A combination of the communication state and shut-off state of the third shut-off valve 3203 and the fourth shut-off valve 3204, provided in the second T-shaped pipe 3302, enables the tube 3104 to communicate selectively with one of the replacement tank 3001 and the space forming base material 2002.

The fourth channel includes a tube 3107 and a tube 3108. The tube 3108, included in the fourth channel, is coupled to the replacement tank (second storing unit) 3001 via the pedestal 3003, constituting an injection needle-like second coupling port 3006 and a coupling channel. That is, the injection needle-like second coupling port 3006 pierces rubber 3502 provided at the bottom of the replacement tank 3001 to couple the tube 3108 to the replacement tank 3001. The replacement tank 3001 is coupled to a coupling pipe 3403 in the buffer tank 3002 via a fifth shut-off valve 3205 that allows the tubes 3107 and 3108 to be switched between the communication state and the shut-off state.

The tubes constituting the third and fourth channels are composed of a material offering a water vapor barrier property and flexibility, for example, high-density polyecthylene. This enables evaporation of the applying liquid in the channels to be minimized, and allows the ink jet printing apparatus with the liquid channel 3000 mounted therein to be more easily assembled.

An atmosphere communication pipe 3001*a* is provided in the replacement tank 3001. A lower end of the atmosphere communication pipe 3001*a* communicates with the opening of the second coupling pipe 3006. An upper end of the atmosphere communication pipe 3001*a* projects into an air layer A in the replacement tank 3001. In this configuration, opening the fifth shut-off valve 3205 allows the internal pressure of the replacement tank 3001 and the atmospheric pressure to be balanced without causing the applying liquid in the replacement tank 3001 to flow out to the liquid channel. Furthermore, the provision of the fourth channel eliminates the need to provide the atmosphere communication port in the replacement tank 3001.

Moreover, the provision of the fourth channel enables circulative refilling when the applying liquid in the replacement tank 3001 is refilled into the buffer tank 3002. When the applying liquid is refilled into the buffer tank 3002, if the applying liquid remains in the buffer tank 3002, the remaining applying liquid may be thickened by evaporation or the like. However, according to the present embodiment, the applying liquid supplied to the buffer tank 3002 dissolves the remaining applying liquid, and the dissolved applying liquid is fed to the replacement tank 3001. That is, the applying liquid is circulatively refilled into the buffer tank 3002. This enables the adverse effect of evaporation from the buffer tank 3002 on the applying liquid to be mitigated.

Moreover, in the present embodiment, the coupling pipes 3005 and 3006 are shaped like needles, and the bottom portion of the replacement tank 3001 is sealed with rubber. Thus, even when the replacement tank 3001 is removed from the coupling pipes 3005 and 3006, possible evaporation of the applying liquid from the replacement tank 3001 can be inhibited.

As described above, in the present embodiment, the collecting channel (second channel) and the refilling channel (third channel) are joined together on the upstream side of the pump 3007. Furthermore, the channel 3104, leading to the pump 3007, is switched to communicate selectively with one of the collecting channel and the refilling channel. This switching can be achieved by switching the third and fourth shut-off valves 3203 and 3204. For example, if the shut-off valve collecting channel is coupled to the pump 3007, the refilling channel is not coupled to the pump 3007. In this condition, driving the pump 3007 allows the circulation of the applying liquid through the first channel, the liquid holding space S, and the second channel as well as the supply and collection of the applying liquid to and from the liquid holding space S through the first and second channels, as described below.

On the other hand, if the third and fourth shut-off valves 3203 and 3204 are switched to couple the refilling channel to the pump 3007, the collecting pump is not coupled to the pump 3007. Thus, in this case, the applying liquid from the replacement tank 3001 can be refilled into the buffer tank 3002 via the refilling channel.

Thus, in the present embodiment, the upstream side of the pump 3007 is coupled to the junction portion between the collecting channel and the refilling channel so as to allow the channels to be switched between the communication state and the shut-off state. Consequently, one of the channels can be selectively allowed to communicate with the pump. The single pump can thus be used to control the channels with the buffer tank 3002 and the replacement tank 3001. Accordingly, even if the buffer tank and the replacement tank are arranged in the same apparatus, the need to increase the number of pumps is eliminated. This enables inhibition of an increase in the number of channels and control sections resulting from an increase in the number of pumps as well as an increase in the number of parts including the pump. The present embodiment can therefore avoid increasing the size and costs of the apparatus.

Furthermore, in the present embodiment, the applying liquid circulates through the first channel, the liquid holding space S, the second channel, and the buffer tank 3002 during the applying operation. Thus, provision of filter or the like in the channels enable dirt, paper dust, and the like mixed into the ink during the applying operation to be removed. Consequently, possible blockage of the needle-like coupling pipes with dirt can be avoided.

To stabilize the amount of the applying liquid fed from the liquid holding space S to the applying roller 1001, it is desirable to inhibit a possible variation in water head difference between the level of the applying liquid in the storage tank and the liquid holding space S even with consumption of the applying liquid in the storage tank. The height of the storage tank maybe reduced to inhibit the possible variation in water head difference resulting from the consumption of the applying liquid in the storage tank. However, since increasing the amount of applying liquid that can be stored in the storage tank is more preferable, to increase the amount of the applying liquid stored in a storage tank with a small height requires an increase in the bottom surface area of the storage container. However, this may increase the size of the apparatus.

Thus, the present embodiment uses the replacement tank 3001 and the buffer tank 3002, which provide the different functions. That is, the buffer tank 3002, having a smaller volume than the replacement tank 3001 and having a smaller height than at least the replacement tank 3001, is used to circulate, fill, and collect the applying liquid through, into, and from the liquid holding space S. Furthermore, the replacement tank 3001, having a greater volume than the buffer tank 3002, allows a large amount of applying liquid to be stored in the same apparatus. Since the volume of the buffer tank 3002 is smaller than that of the replacement tank 3001, the applying liquid in the buffer tank 3002 is used up earlier than that in the replacement tank 3001. However, the application ink in the replacement tank 3001 is refilled into the buffer tank 3002 as required. Thus, with a large amount of applying liquid stored in the apparatus, the height of the storage tank (buffer tank) can be reduced which is associated with the filling, collection, and circulation of the applying liquid into, from, and through the liquid holding space S. This enables inhibition of a possible variation in water head difference between the level of the applying liquid in the buffer tank 3002 and the liquid holding space S even with consumption of the applying liquid in the buffer tank 3002. As a result, the amount of the applying liquid applied by the applying roller 1001 can be stabilized.

Additionally, the inhibition of the possible variation in water head difference allows the wear of the applying roller 1001 and the abutting member 2009 to be mitigated. In the present embodiment, since the pump 3007 is provided on a side of the apparatus on which the applying liquid is collected in the buffer tank 3002, the pressure at the liquid collecting port 2005 is relatively lower than that at the liquid supply port 2004. Consequently, circulation based on a pressure reduction method is achieved. Thus, a negative pressure is generated in the liquid holding space S and increases consistently with the water head difference. In the present embodiment, the urging of the spring member 2006 is used to press the abutting member 2009 against the applying roller 1001. If the negative pressure is increased by the increased water head difference as described above, the pressing force is also increased. The increased pressing force increases the abutting pressure between the applying roller 1001 and the abutting portion of the abutting member 2009 and thus the amount of wear between the abutting portion and the applying roller. As a result, the lifetime of the abutting portion is shortened.

However, the present embodiment can inhibit the possible variation in water head difference, thus enabling a reduction in the amount of wear and an increase in the lifetime of the applying roller 1001 and the abutting member 2009.

1.4. Control System

Figure 13:
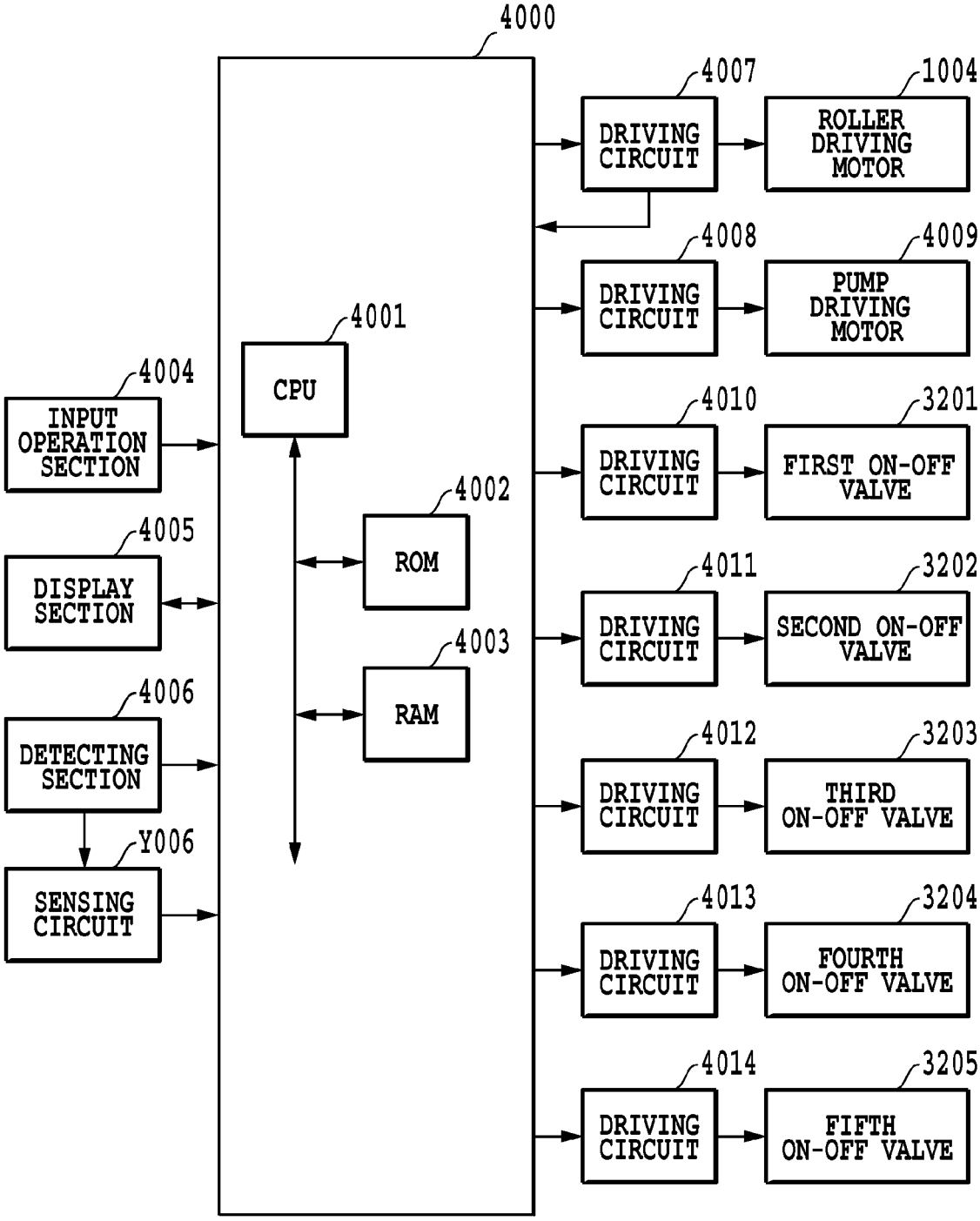
FIG. 13 is a block diagram showing a general configuration of a control system in the embodiment of the applying apparatus according to the present invention.

FIG. 13 is a block diagram generally showing the configuration of the control system in the liquid applying apparatus according to the present embodiment.

In the FIG. 13, reference numeral 4000 denotes a control section 4000 as control unit for controlling the whole liquid applying apparatus. The control section 4000 has a CPU 4001 that performs various processes such as calculations, control, and determinations. The control section 4000 also has a ROM 4002 that stores control programs for processes described below with reference to FIG. 14 and a RAM 4003 that temporarily stores data used during process operations by the CPU 4001 as well as input data.

The control section 4000 connects to an input operation section 4004 including a keyboard, various switches, or the like with which predetermined instructions or data are input, and a display section 4005 that provides various displays including inputs to and the set state of the liquid applying apparatus. The control section 4000 also connected to a detecting section 4006 including a sensor or the like which detects the position of an applying medium or the operational state of each section, and a liquid detecting circuit Y006. The control section 4006 includes the above-described liquid sensor Y001, constituting a part of the control section 4006. The control section 4000 further connects to the roller driving motor 1004, a pump driving motor 4009, and the first to fifth on-off valves via driving circuits 4007, 4008, 4010, and 4011. The roller driving motor 1004 and the driving circuit 4007, which drives the roller driving motor 1004, constitute roller driving unit.

In the present embodiment, each of the roller driving motor 1004 and the pump driving motor 4009 is composed of a DC motor. A driving current for each of the motors 1004 and 4009 or the duty ratio of PWM control of each of the motors 1004 and 4009 is controlled according to a variation in load. Thus, the motors 1004 and 4009 can basically be stably rotated at a specified driving speed regardless of a variation in load.

Each of the shut-off valves is switched between the communication state and the shut-off state according to a control signal from the control section 4000, described below. This allows the filling, supply, and collection of the applying liquid. Specific operations will be described below in detail.

1.5. Liquid Applying Operation

Now, a control procedure performed by the control section of the liquid applying apparatus according to the present embodiment and relating to the liquid applying operation will be described.

Figure 14:
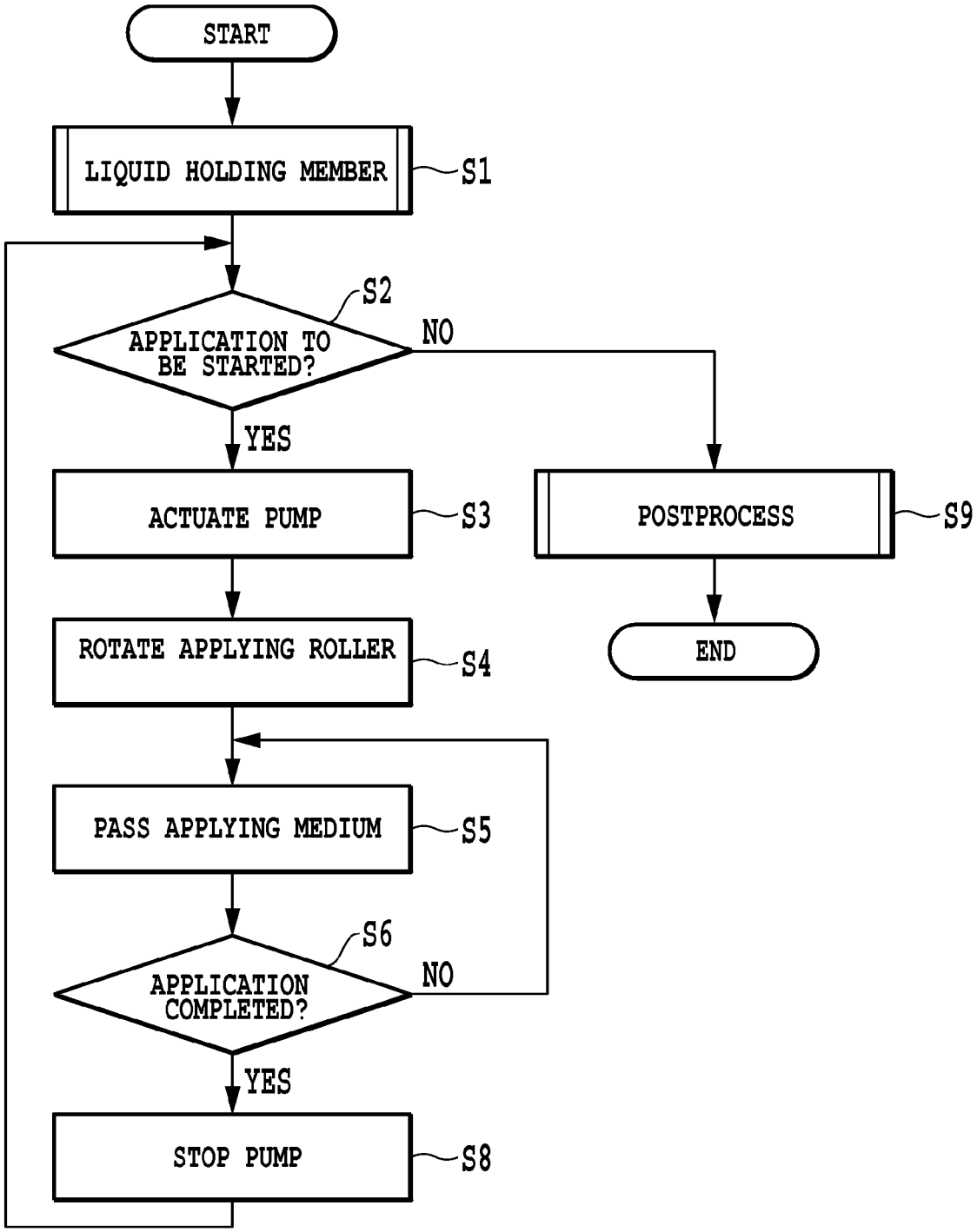
FIG. 14 is a flowchart showing a sequence of a liquid applying operation according to the embodiment of the present invention.

Powering on the liquid applying apparatus allows the control section 4000 to execute an applying operation sequence (steps S1 to S9) shown in a flowchart shown in FIG. 14. Steps for the liquid application will be described below with reference to the flowchart.

(Filling Step)

In step S1 in FIG. 14, a step of filling the applying liquid into the applying space S is carried out. In the filling step, operations such as "uncontrolled", "refilling", "application", and "collection" are performed according a flowchart in FIG. 15. These operations are performed by switching the above-described shut-off valves according to such combinations as shown in Table 1. The combinations of the open and closed states of the shut-off valves are specified according to the four states of the apparatus, shown in Table 1, that is, "uncontrolled", "refilling", "application", and "collection". The control section 4000 transmits a control signal to each of the shut-off valves instructing the shut-off valve to be opened or closed, depending on the state to be established in the applying apparatus.

TABLE 1

| | First shut-off valve | Second shut-off valve | Third shut-off valve | Fourth shut-off valve | Fifth shut-off valve |
|---|---|---|---|---|---|
| Uncontrolled | Close | Open | Close | Close | Close |
| Refilling | Close | Close | Close | Open | Open |
| Circulation | Open | Close | Open | Close | Close |
| Collection | Close | Open | Open | Close | Close |

In Table 1, the "uncontrolled" state refers to the state in which the apparatus is not in operation and in which the applying liquid has been collected from the liquid holding space S. In this case, only the second shut-off valve 3202 is in the "open" state. The "refilling" state means the state in which the applying liquid is fed from the replacement tank to the buffer tank 3002 for refilling. In this case, only the fourth shut-off valve 3204 and the fifth shut-off valve 3205 are in the "open" state. The "circulation" state means the state in which the applying liquid is circulated through the buffer tank 3002, the first channel, the liquid holding space S, and the second channel. In this case, only the first shut-off valve 3201 and the third shut-off valve 3203 are in the "open" state. The "collection" state means the state in which the applying liquid is fed from the liquid holding space S to the buffer tank for collection. In this case, only the second shut-off valve 3202 and the third shut-off valve 3203 are in the "open" state.

To establish the "uncontrolled" state, the shut-off valve 3202 may be brought into the "open" state. In this case, the liquid holding space S is completely shut off from the buffer tank 3002. Thus, regardless of the situation while the apparatus is not in operation, the applying liquid in the buffer tank 3002 is prevented from entering the liquid holding space S.

In the filling step, first, the open and closed states of the shut-off valves are set according to the combination for the "circulation" state shown in Table 1 (S100*a*) With this combination of the open and closed states, the buffer tank 3002 communicates with the liquid applying space S through the first and second channels.

Thereafter, the pump 3007 is driven, with the liquid sensor Y001 monitoring the relevant sections for the presence of the liquid (S101). Thus, the applying liquid is fed to the first channel, the liquid applying space S, the tube 3103, and the liquid sensor Y001 in this order. When the channel Y001*a* in the liquid sensor Y001 is filled with the applying liquid, the liquid sensor Y001 senses a liquid "presence" state (S102) to stop the driving of the pump 3007. This step allows the applying liquid supplied to the liquid holding space S to be fed to the applying roller 1001, thus enabling the applying liquid to be applied to the applying medium (S105).

However, even though the pump 3007 is driven enough to fill the liquid sensor Y001 with the liquid, the liquid sensor may infrequently fail to sense the liquid "presence" state. Possible causes are, for example, as follows.

(1) A defect in the pump or the circulating path.
(2) The applying liquid is thickened in the pump to increase viscous resistance, thus preventing the liquid to flow normally at the pump driving speed.
(3) The applying liquid is thickened in the liquid channel to reduce the flow speed.
(4) In spite of the presence of the applying liquid in the channel Y001*a* in the liquid sensor Y001, the liquid "presence" state fails to be sensed.

Figure 15:
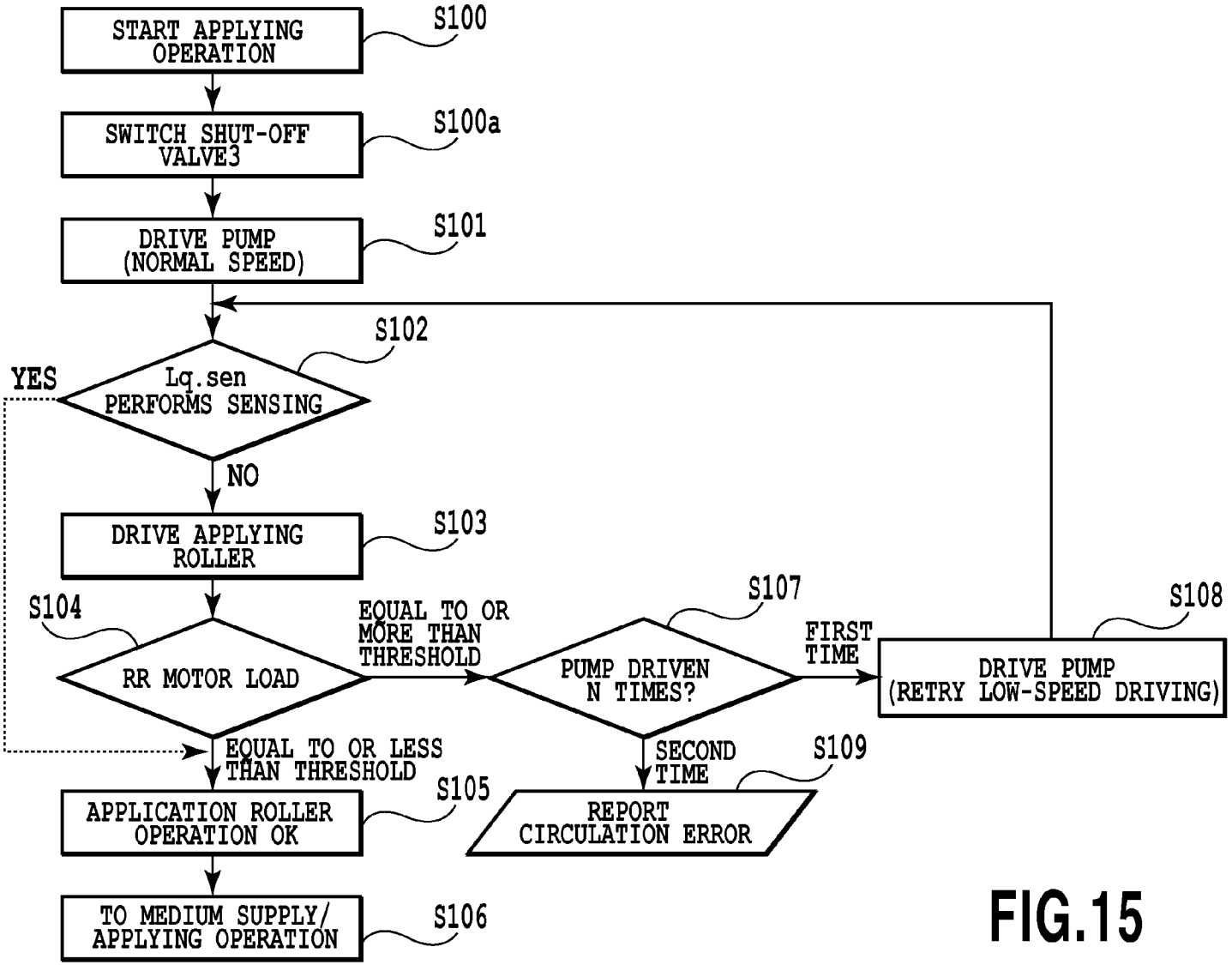
FIG. 15 is a flowchart showing the operation of a filling step according to the embodiment of the present invention.

In the above-described cases, in the filling step, operations described below are performed according to the flowchart in FIG. 15.

First, if the liquid sensor Y001 fails to sense the liquid "presence" state even though the pump 3007 is driven for a sufficient time (S102), the roller driving motor 1004 is driven to rotate the applying roller 1001 (S103). The current driving load is then detected (S104). The detection of the driving load is performed by the control section 4000 based on, for example, the driving current for the roller driving motor 1004 or the duty ratio of the PWM control of the roller driving motor 1004. That is, in the present embodiment, the control section 4000 provides the function of load detecting unit for detecting the driving load. Furthermore, if the detected load is equal to or less than a predetermined threshold, the control section 4000 determines that the applying liquid is present in the liquid applying space S (S105). The control section 4000 then performs the subsequent part of the applying operation (S106).

If the load detected in the above-described step S104 is equal to or more than the threshold, the control section 4000 determines that no applying liquid is present in the liquid applying section S. The control section 4000 thus shifts to step S107. In step S107, the control section 4000 determines the number of times the pump 3007 has been driven since reception of an instruction to start the applying operation. Here, if the pump 3007 has been driven once, that is, if step S101 corresponds to the only previous driving of the pump 3007, the control section 4000 drives the pump 3007 again (second driving) in order to fill the liquid applying space S with the applying liquid (S108). The control section 4000 thus performs an operation of re-supplying the applying liquid (S108). As a result of the re-supply operation, if the liquid sensor Y001 senses the "presence" of the applying liquid, the control section 4000 determines that the applying liquid is present in the liquid applying space S (S105). The control section 4000 thus performs the applying operation (S106).

If the liquid sensor Y001 fails to sense the applying liquid "presence" state in spite of the re-driving (re-supply operation) of the pump 3007, the control section 4000 drives the applying roller 1001 again (S103). The control section 4000 thus detects the driving load on the roller driving motor 1004 (S104). If the driving load is less than the threshold, the control section 4000 determines that the applying liquid is present in the liquid applying space S (S105). The control section 4000 thus performs the applying operation (S106).

If the driving load is determined again to be equal to or more than the threshold, the control section 4000 determines that a certain error is occurring in the pump 3007 or the fluid channel 3000. The control section 4000 shifts to step S107. In this case, since the pump 3007 has been driven twice, the control section 4000 drives a predetermined reporting section to notify the user of the error (S109).

When the pump 3007 is re-driven in the above-described step S108, the driving speed of the pump 3007 may be changed. For example, an increase in driving speed enables the pump 3007 to generate a higher negative pressure on the collection side of the liquid channel. Thus, even if the applying liquid is thickened to reduce the flow speed, the flow speed of the applying liquid can be raised to increase the amount of liquid supplied per unit time. Furthermore, even if the applying liquid is thickened in the pump, a reduction in driving speed allows the pump 3007 to function normally.

Furthermore, in step S103, the roller driving motor 1004 may be driven utilizing a preliminary operation for the operation of conveying the medium. The preliminary operation may be, for example, a fixed liquid removing operation. The preliminary operation eliminates the need to add a new operation for sensing whether or not the applying liquid is present in the liquid applying space S. Operation time can thus be reduced.

(Refilling Step)

Now, a step of refilling the applying liquid into the liquid applying space S will be described.

In step S1, if for example, a liquid level managing sensor (liquid level detecting unit) for sensing the height of the liquid level in the liquid holding member determines that the amount of applying liquid in the buffer tank 3002 is insufficient, the shut-off valves are set according to the combination of the open and closed states for the "refilling". Thereafter, the pump 3007 is driven for a given time. This combination of the open and closed states allows the buffer tank 3002 to communicate with the replacement tank 3001 through the third and fourth channels. Thus, the applying liquid is refilled into the buffer tank 3002.

Figure 24:
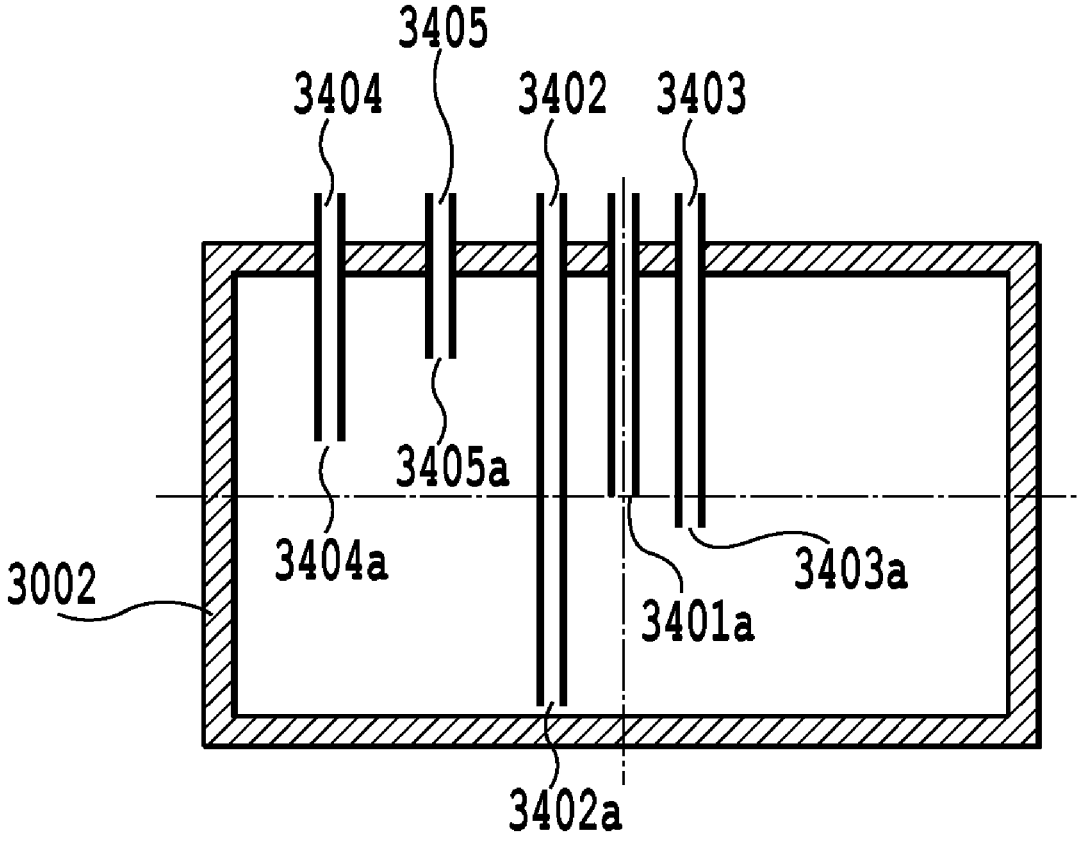
FIG. 24 is a diagram showing a buffer tank according to the embodiment of the present invention.
Figure 25:
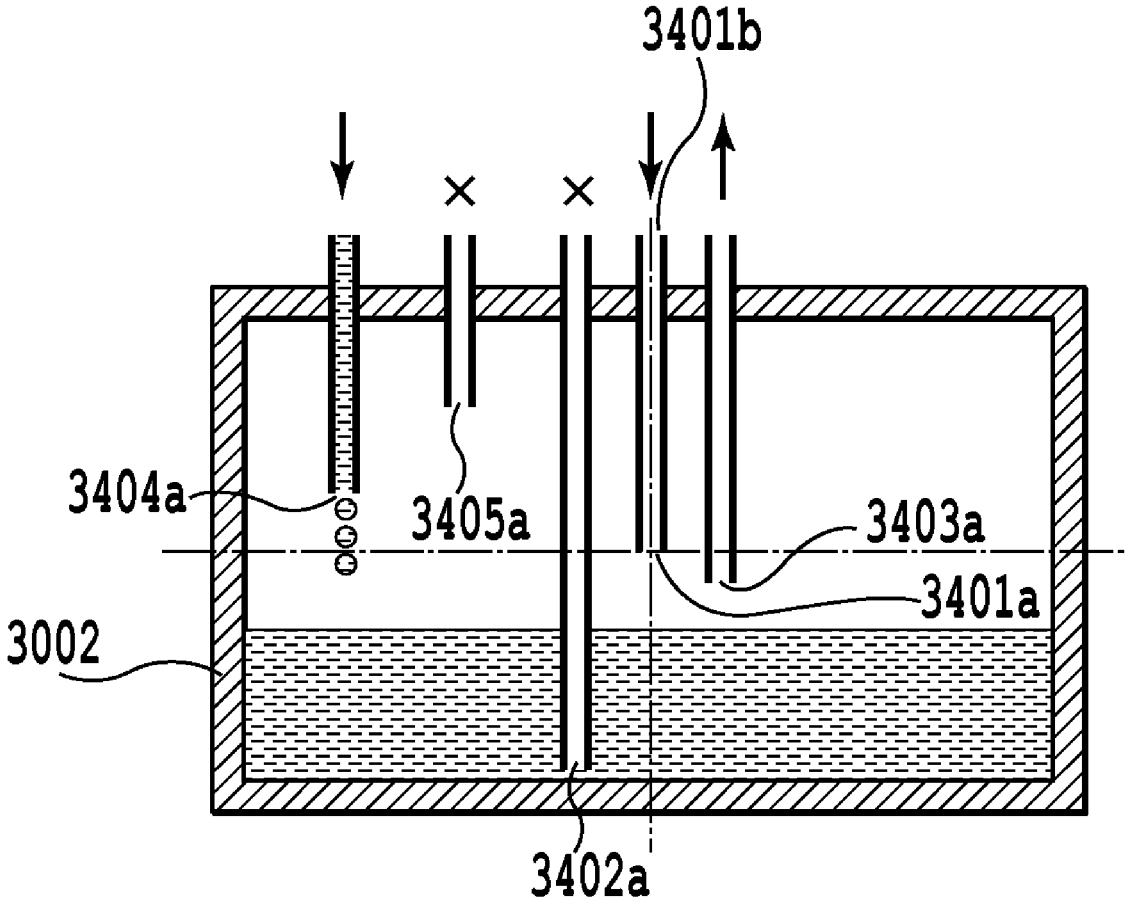
FIG. 25 is a diagram showing the buffer tank according to the embodiment of the present invention.
Figure 26:
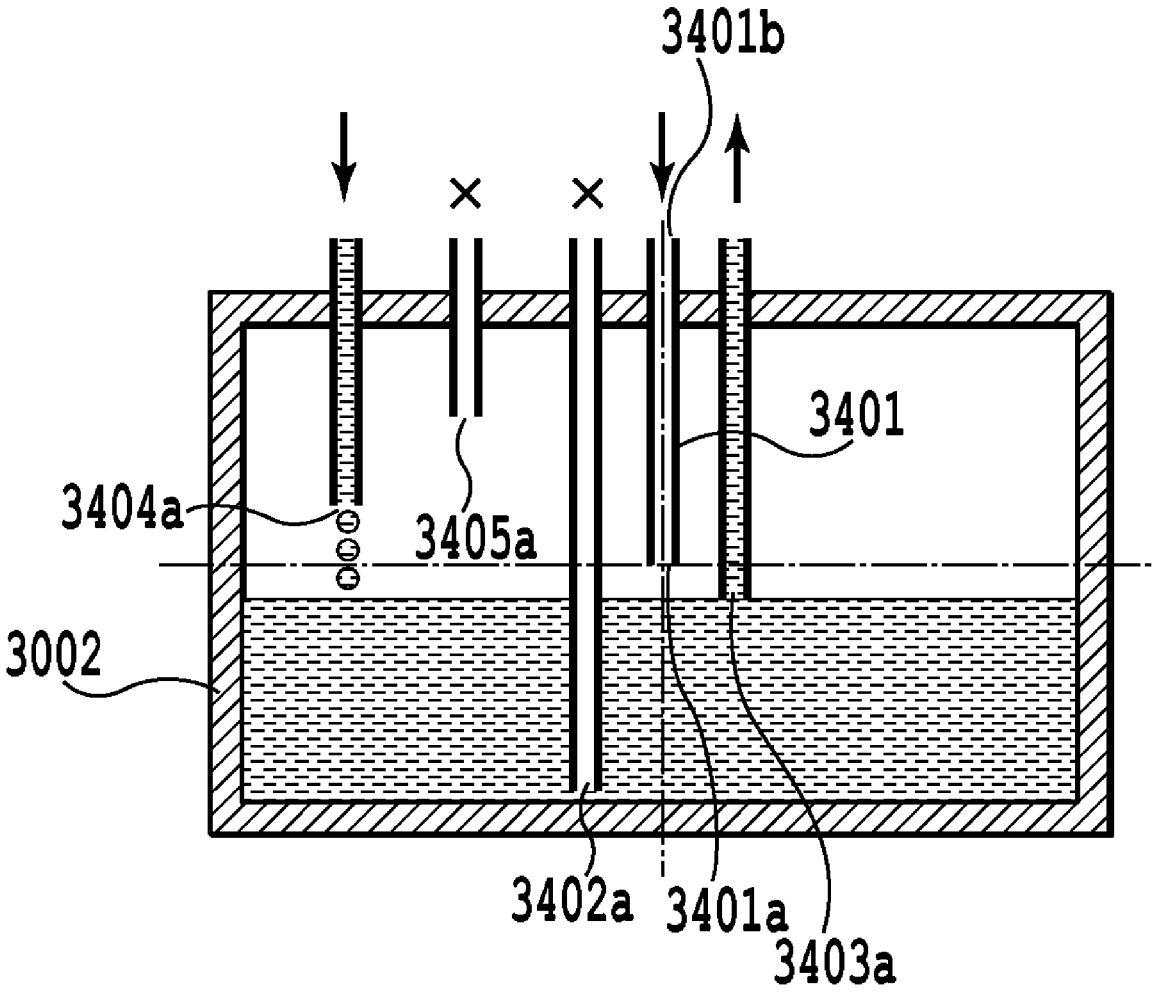
FIG. 26 is a diagram showing the buffer tank according to the embodiment of the present invention.

In the present embodiment, to refill the appropriate amount of applying liquid into the buffer tank 3002, the buffer tank 3002 is configured as shown in FIGS. 24 to 26.

As shown in FIG. 24, the internal space of the buffer tank 3002 according to the present embodiment is shaped like a rectangular parallelepiped. As described above, the coupling pipes 3401 to 3405 are provided through a top surface of the buffer tank 3002. The coupling pipe 3401 is an atmosphere communication pipe. Furthermore, the tube 3101 is coupled to the coupling pipe 3402, and the tube 3107 is coupled to the coupling pipe 3403. The tube 3105 is coupled to the coupling pipe 3404.

Now, a vertical positional relationship among the openings of the tubes 3401 to 3405 in the buffer tank 3002 will be described. The vertical position of the opening 3404*a* is not particularly restricted. In the present example, the vertical position of the opening 3404*a* is specified to be slightly above an intermediate position as shown in FIG. 24. The opening 3402*a* is located close to a bottom surface of the buffer tank 3002 so as to allow the applying liquid in the buffer tank 3002 to be effectively used. The opening 3405*a* needs to communicate with the atmosphere communication pipe 3401 via the interior of the buffer tank 3002 during a collecting operation. Thus, the vertical position of the opening 3405*a* is specified to be closest to the top surface of the buffer tank 3002. However, during the refilling operation, the channels communicating with the openings 3402*a* and 3405*a* are shut off by the respective valves as shown in FIG. 15. Thus, this state is equivalent to a configuration without an opening.

In the present embodiment, the opening 3401*a* is located at a central position in the internal space of the buffer tank 3002. Here, the center of gravity of the buffer tank 3002 formed when the internal space of the buffer tank 3002 is shaped by a uniform substance is defined as the center of the internal space of the buffer tank 3002.

The vertical position of the opening 3403*a* is specified to be closer to the bottom surface of the buffer tank 3002 than that of the opening 3401*a*. That is, in a posture (a normal posture assumed by the buffer tank 3002 while the applying apparatus is in use) in which the bottom surface of the buffer tank 3002 is parallel to the level of the applying liquid in the buffer tank 3002 as shown in FIG. 25, the opening 3403*a* is positioned below the opening 3401*a* in the direction of the gravity.

During the refilling of the applying liquid, the pump 3007 is driven to allow the applying liquid in the replacement tank 3001 to flow into the buffer tank 3002 via the third channel and the tubes 3104 and 3105 as shown in FIGS. 25 and 26. At this time, the refilling of the applying liquid into the buffer tank 3002 is performed until the level of the applying liquid reaches the opening 3403*a*, corresponding to an end of the fourth channel. When the applying liquid is filled up to the end 3403 of the fourth channel, even if the applying liquid is subsequently fed from the replacement tank 3001 to the buffer tank 3002 for refilling, an amount of applying liquid refilled (refill amount) flows into the opening 3403*a* and is returned to the replacement tank 3001. That is, the applying liquid circulates between the replacement tank 3001 and the buffer tank 3002. Consequently, the level in the buffer tank 3002 remains unchanged. Thus, the amount of the applying liquid refilled into the buffer tank 3002 is always limited such that the liquid level is equal to the height of the opening 3404*a* (returning opening). That is, the channel from the opening 3403*a* of the coupling pipe 3403 to the replacement tank 3001 functions as storage amount limiting unit. Thus, in the refilling step, even when the pump 3007 is continuously driven for at least a predetermined time, the applying liquid is prevented from overflowing the opening 3401*b* at the upper end of the atmosphere communication pipe 3401.

In an alternative configuration, a sensor may be provided in the buffer tank 3002 to sense a water level lower than the position of the atmosphere communication pipe 3401, which is an atmosphere communication port, in the direction of the gravity. This eliminates the need for the fourth channel. However, both the fourth channel and the sensor may be provided to allow for a defect in the sensor detecting the water level.

Alternatively, another water level sensor may be installed closer to the bottom surface of the buffer tank than the above-described sensor. The second water level sensor can sense that the amount of applying liquid in the buffer tank has decreased. Thus, a signal indicating the sensing of the decrease can be used as a trigger to carry out the refilling step.

Furthermore, in the present embodiment, an end of the coupling pipe 3402, constituting a part of the first channel, is positioned in the vicinity of the bottom of the buffer tank 3002. Bubbles can thus be inhibited from entering the first channel. Thus, the buffer tank 3002 according to the present embodiment includes not only the functions of managing the water, storing the liquid, and managing the water level in the tank but also the function of deairing the channels.

(Applying Step)

As shown in FIG. 14, the step of filling the applying liquid into the liquid holding space S is completed, and an application start instruction is input (step S2). Then, the pump 3007 starts to operate again (step S3). The applying roller 1001 starts rotating clockwise as shown by an arrow in FIG. 1 (step S4). The rotation of the applying roller 1001 causes the applying liquid filled in the liquid holding space S to passes through between the applying roller 1001 and a lower edge of the abutting member 2009 against the pressing force of the abutting member 2009 of the liquid holding member 2001, which force is exerted on the applying roller 1001. The passing applying liquid then attaches to the outer periphery of the applying roller 1001 in layer form. The applying liquid L attached to the applying roller 1001 is fed to the abutting portion between the applying roller 1001 and the counter roller 1002.

Then, an applying medium feeding mechanism 1006 conveys the applying medium to between the applying roller 1001 and the counter roller 1002. The applying medium is interposed between the rollers. The applying medium is further conveyed toward a sheet discharging section as the applying roller 1001 and the counter roller 1002 rotate (step S5). During the conveyance, the applying liquid applied to the outer peripheral surface of the applying roller 1001 is transferred from the applying roller 1001 to the applying medium P as shown in FIG. 9. Of course, means for feeding the applying medium to between the applying roller 1001 and the counter roller 1002 is not limited to the above-described feeding mechanism. Any such mean for supplying the applying medium may be used, for example, manual means supplementarily using a predetermined guide member may be used or the manual means may be independently used.

In FIG. 9, an area with crossing diagonal lines shows the applying liquid L. Here, the thickness of the layer of the applying liquid on the applying roller 1001 and the applying medium P is shown to be excessively larger than the actual one in order to clearly show the condition of the applying liquid L during the application.

As described above, a portion of the applying medium P to which the applying liquid has been applied is conveyed in the direction of an arrow by a conveying force of the applying roller 2001. At the same time, a portion of the applying medium P to which the applying liquid has not been applied is conveyed to the contact portion between the applying medium P and the applying roller 2001. This operation is continuously or intermittently performed to apply the applying liquid to the entire applying medium.

FIG. 9 shows an ideal application state in which all of the applying liquid L having passed through the abutting member 2009 and attached to the applying roller 2001 is transferred to the applying medium P. However, in actuality, not all of the applying liquid attached to the applying roller 1001 is transferred to the applying medium P. That is, when the conveyed applying medium P leaves the applying roller 1001, the applying liquid L often attaches to the applying roller 1001 and remains on the applying roller 1001. The amount of the applying liquid L remaining on the applying roller 1001 depends on the material of the applying medium P and the condition of fine concaves and convexes on the surface of the applying medium P. However, if the applying medium is plain paper, the applying liquid L remains on the peripheral surface of the applying roller 1001 after the applying operation.

Figure 21:
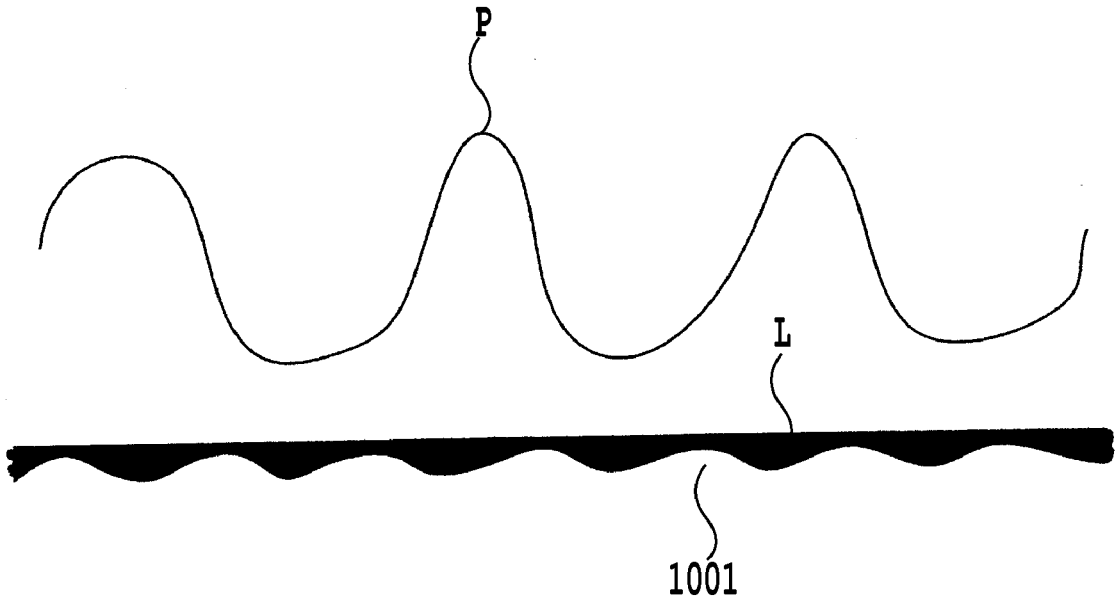
FIG. 21 is a diagram illustrating an applying process carried out between a surface of a medium and an application surface according to the embodiment of the present invention when the medium is plain paper, the diagram showing the condition of an upstream side of a nip portion between an applying roller and a counter roller.
Figure 22:
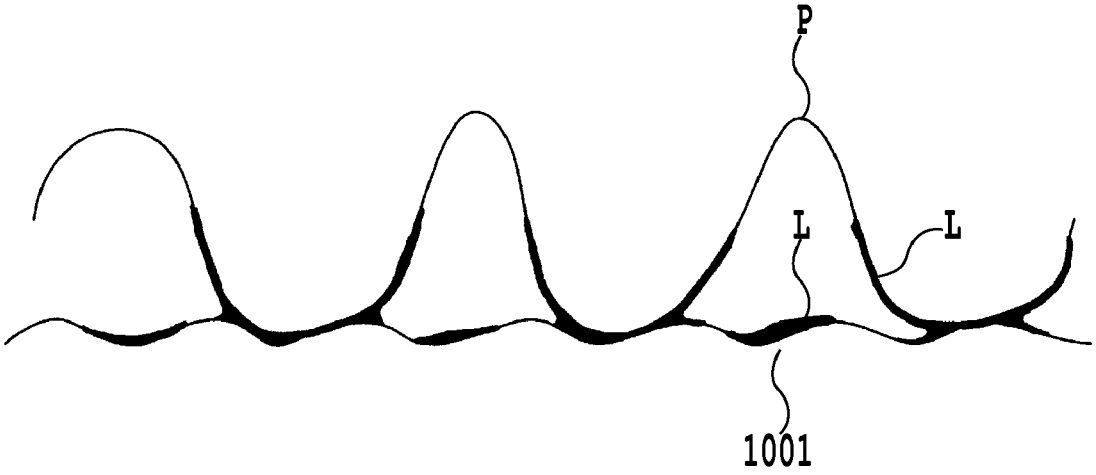
FIG. 22 is a diagram illustrating the applying process carried out between the surface of the medium and the application surface according to the embodiment of the present invention when the medium is plain paper, the diagram showing the condition of the surface of the plain paper, which is the medium, and the application surface of the applying roller 1001 at the nip portion between the applying roller and the counter roller.
Figure 23:
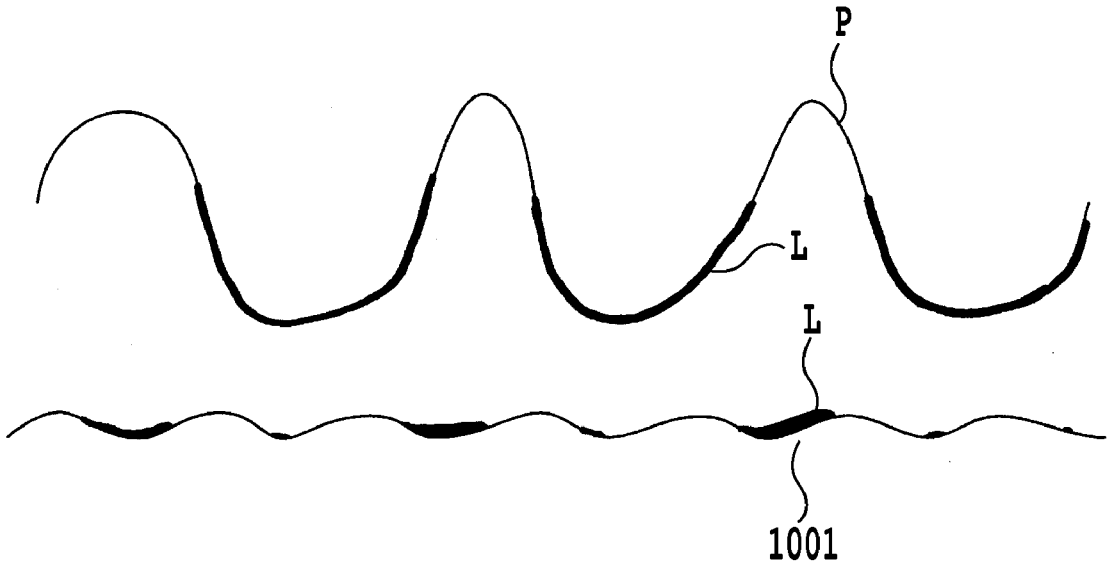
FIG. 23 is a diagram illustrating the applying process carried out between the surface of the medium and the application surface according to the embodiment of the present invention when the medium is plain paper, the diagram showing the condition of a downstream side of the nip portion between the applying roller and the counter roller.

FIGS. 21, 22, and 23 are diagrams illustrating the applying process carried out between the surface of the applying medium and an application surface when the applying medium P is plain paper. In these figures, the liquid is shown in black.

FIG. 21 shows the condition of an upstream side of a nip portion between the applying roller 1001 and the counter roller 1002. In FIG. 21, the liquid is attached to the application surface of the applying roller 1001 so as to slightly cover the fine concaves and convexes on the application surface.

FIG. 22 shows the condition of the surface of the plain paper, which is the applying medium P, and the application surface of the applying roller 1001, at the nip portion between the applying roller 1001 and the counter roller 1002. In FIG. 22, concaves on the surface of the plain paper, which is the applying medium P, contacts the application surface of the applying roller 1001. In portions of the application surface contacted by the liquid, the liquid instantaneously permeates or attaches to fibers in the surface of the plain paper or is, which is the medium P. Furthermore, the attached liquid remains on portions of the application surface of the applying roller 1001 which do not contact the surface of the plain paper.

FIG. 23 shows the condition of a downstream side of the nip portion between the applying roller 1001 and the counter roller 1002. FIG. 23 shows that the medium has completely left the application surface of the applying roller 1001. The liquid remains in portions of the application surface of the applying roller 1001 which do not contact convexes on the surface of the plain paper, and also in the contact portions though the amount of the remaining liquid is very small.

The applying liquid remaining on the applying roller 1001 passes through between the applying roller 1001 and an upper edge 2010 of the abutting member 2009 against the pressing force of the abutting member 2009 of the liquid holding member 2001 exerted on the applying roller 1001. The applying liquid then returns into the liquid holding space S. The applying liquid having returned into the liquid holding space S is mixed with the applying liquid filled in the space S.

Figure 10:
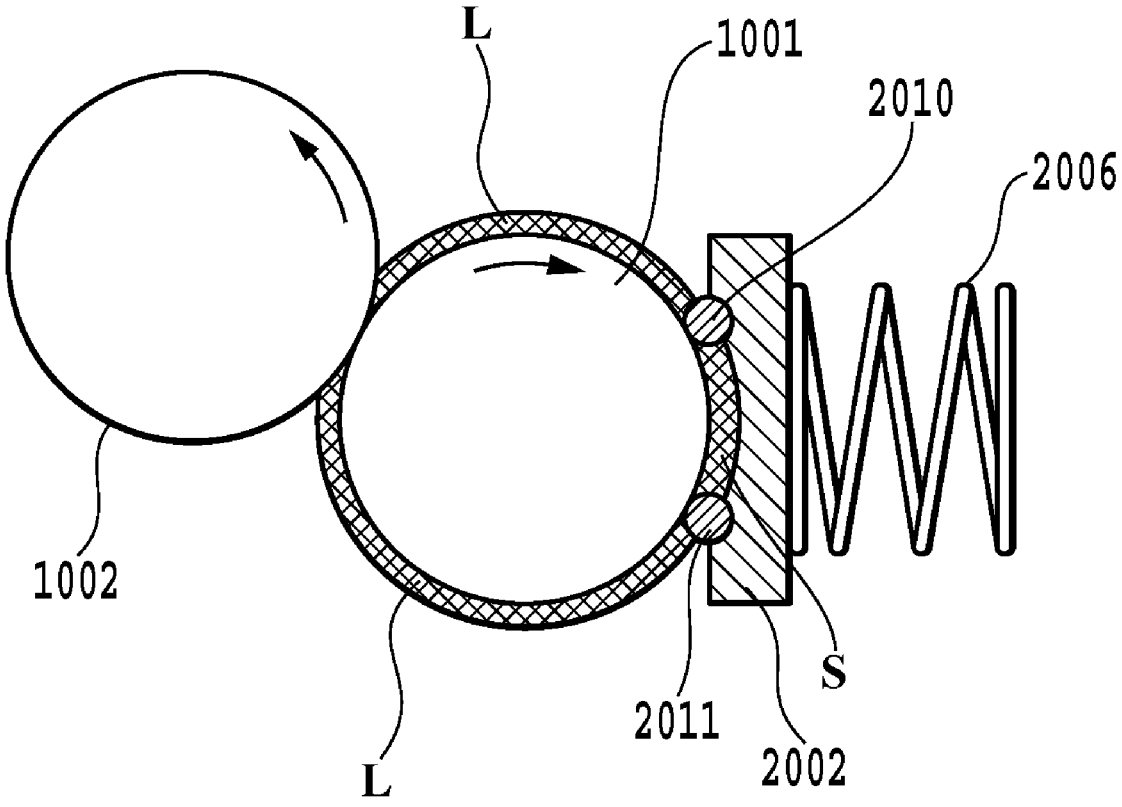
FIG. 10 is a vertical sectional view showing how the applying liquid is filled into the liquid holding space formed by the liquid holding member and the applying roller and how the applying roller is rotated when no applying medium is present.

The operation of returning the applying liquid is similarly performed if the applying roller 1001 is rotated with no applying medium present as shown in FIG. 10. That is, rotation of the applying roller 1001 allows the applying liquid attached to the outer periphery of the applying roller 1001 to pass through the portion (nip portion) between the applying roller 1001 and the counter roller 1002. After passing through the nip portion, the applying liquid is separated into two flows toward the applying roller 1001 and the counter roller 1002, respectively, with a certain amount of applying liquid remaining on the applying roller 1001. The applying liquid L attached to the applying roller 1001 passes through between the upper edge 2010 of the abutting member 2009 and the applying roller 1001 and enters the liquid holding space S. The applying liquid L is then mixed with the applying liquid filled in the space S.

(Fixed Liquid Removing Operation)

Figure 27:
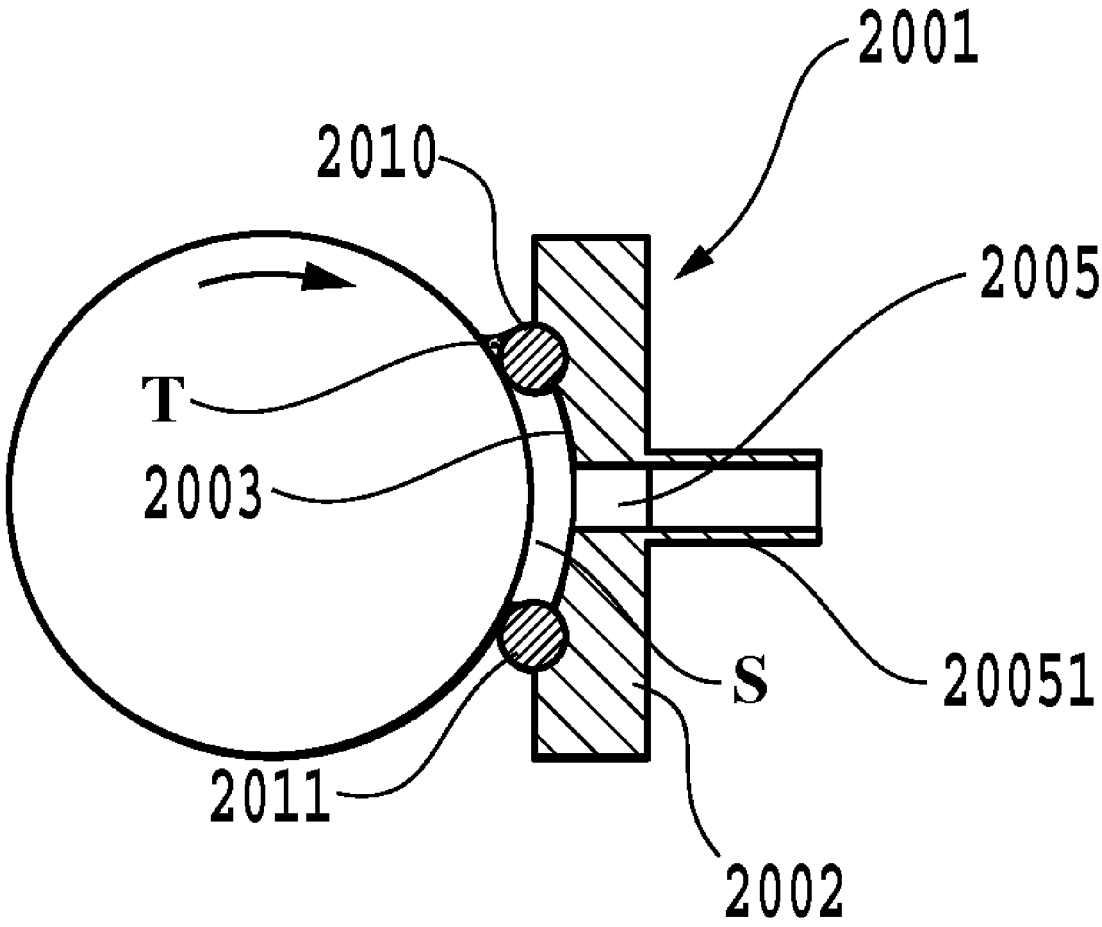
FIG. 27 is a schematic sectional view of a nip portion between the applying roller and an abutting member according to the embodiment of the present invention.

In the present embodiment, during the above-described operation of returning the applying liquid, most of the applying liquid passes through between the upper edge 2010 of the abutting member 2009 and the applying roller 1001. However, a portion of the applying liquid is scraped by the upper edge 2010 of the abutting member 2009. As shown in FIG. 27, a portion of the applying liquid remains at the nip portion between the applying roller 1001 and the abutting member 2009 and close to the nip portion; this portion is denoted by reference character T. Furthermore, the applied liquid may be integrated into droplets depending on the surface tension of the liquid. When the applying liquid is left in this condition for a long time, moisture in the applying liquid evaporates. The applying liquid thus remains on the surface of the applying roller 1001 with the viscosity thereof increased. When the applying liquid continues to be left uncontrolled, nonvolatile components in the applying liquid alone remain. The applying liquid is thus fixed to the nip portion between the applying roller 1001 and the abutting member 2009. When the applying operation is started with the thickened applying liquid or the nonvolatile components of the applying liquid thus fixed to a part of the surface of the applying roller 1001 (for example, the nip portion between the applying roller 1001 and the abutting member 2009), a large amount of applying liquid attaches only to that part. This prevents an even layer of the applying medium from being formed on the applying roller 1001, resulting in nonuniform application of the applying liquid to the applying medium P.

Thus, according to the present embodiment, before the applying operation, the volume of the liquid in the liquid holding space S contacted by the applying roller 1001 per unit time before the applying operation is set to be greater than that during the applying operation. This promotes re-dissolution of the fixed applying liquid. That is, before the applying operation, an operation of rotating the applying roller 1001 at a low speed is performed with the liquid holding space S full of the applying liquid and without passage of the applying medium P. This enables re-dissolution of the thickened applying liquid or the nonvolatile components fixed to the surface of the applying roller 1001. The operation for the re-dissolution is hereinafter referred to as a fixed liquid removing operation. Performing the fixed liquid removing operation as described above enables an even layer of the applying liquid to be formed on the surface of the applying roller. This allows avoidance of nonuniform application of the applying liquid to the applying medium P.

Figure 28:
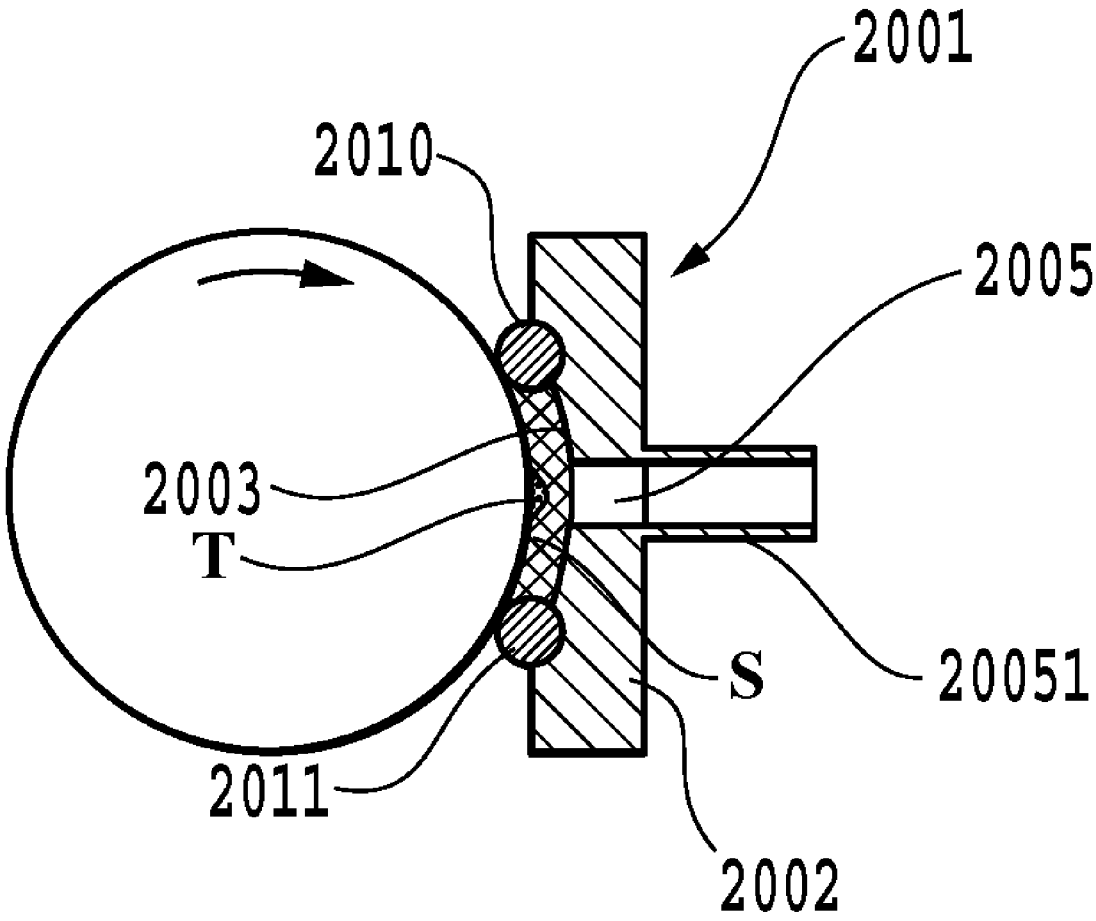
FIG. 28 is a schematic sectional view of the nip portion between the applying roller and the abutting member according to the embodiment of the present invention.
Figure 29:
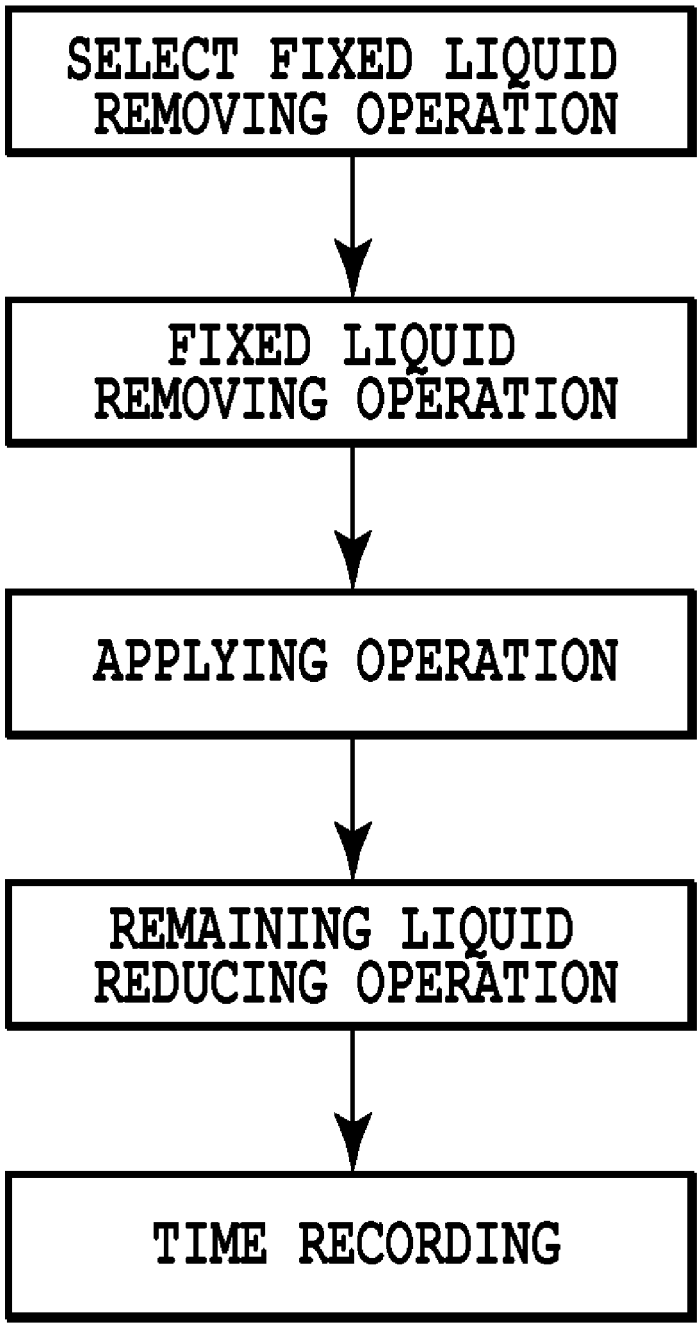
FIG. 29 is a flowchart showing a fixed liquid removing operation according to the embodiment of the present invention.

FIG. 28 is a diagram schematically showing how the applying liquid removing operation is performed. As shown in FIG. 27, with the thickened and fixed applying liquid T (hereinafter referred to as the fixed liquid) present at the nip portion between the applying roller 1001 and the abutting member 2009, the applying roller 1001 is rotated in the direction of an arrow in the figure. Then, the fixed liquid T adheres to the applying roller 1001 and enters the liquid holding space S. At this time, a reduction in the rotation speed of the applying roller 1001 increases time for which the fixed liquid T on the applying roller 1001 contacts the applying liquid held in the liquid holding space S. That is, the volume of the liquid in the liquid holding space S contacted by the applying roller 1001 per unit time increases. This promotes the re-dissolution of the fixed liquid T, enabling the fixed liquid T to be removed. In this operation, the applying roller 1001 needs to rotate at a low speed only during a part of one rotation of the applying roller 1001 when a position on the applying roller 1001 contacted by the abutting member 2009 before starting of the applying roller 1001 passes through the liquid holding space S.

During the fixed liquid removing operation, the amount of rotating operation of the applying roller 1001 is effectively increased to prolong the time during which the fixed liquid L contacts the applying liquid present in the liquid holding space S. In this case, increasing the amount of rotating operation of the applying roller 1001 also allows the upper edge 2010 of the abutting member 2009 to exert a force for scraping the fixed liquid L. The fixed liquid can thus be more effectively removed.

Table 2 shows the results of tests on the evenness of the applying liquid applied to the surface of the applying roller with the speed and amount of rotating operation of the applying roller 1001 varied during the fixed liquid removing operation. The tests involve a case equivalent to a 60-hour uncontrolled state and a case equivalent to a 120-hour uncontrolled state. Driving conditions include the peripheral speed and rotation number of the applying roller 1001. In Table 2, circles denote a case in which the evenness of the applying liquid applied to the surface of the applying roller is acceptable. Triangles denote a condition in which the applied applying liquid includes an insignificantly uneven portion. Crosses denote a condition in which the applied applying liquid includes a significantly uneven portion.

TABLE 2

| | | | Amount of rotating operation [rotation] of applying member | | | | |
|---|---|---|---|---|---|---|---|
| | | | 1 | 2 | 3 | 4 | 5 |
| Case equivalent to 60-hour uncontrolled state | Rotation speed of applying member [inch/sec] | 2.0 | Δ | ○ | ○ | ○ | ○ |
| | | 3.3 | x | ○ | ○ | ○ | ○ |
| | | 5.3 | x | x | x | x | x |

TABLE 2-continued

| | | | Amount of rotating operation [rotation] of applying member | | | | |
|---|---|---|---|---|---|---|---|
| | | | 1 | 2 | 3 | 4 | 5 |
| Case equivalent to 120-hour uncontrolled state | Rotation speed of applying member [inch/sec] | 2.0 | x | Δ | ○ | ○ | ○ |
| | | 3.3 | x | x | Δ | Δ | — |
| | | 5.3 | x | x | x | x | x |

The results indicate that the disadvantageous unevenness of the applying liquid applied to the applying roller surface which is caused by the attachment of the fixed liquid L can be more effectively avoided by reducing the rotation speed of the applying roller 1001, while increasing the rotation amount of the applying roller 1001.

Furthermore, by providing an appropriate time (standby time) during which the applying roller 1001 is stopped with the fixed liquid T on the applying roller 1001 kept in contact with the applying liquid held in the liquid holding space S (FIG. 28), the re-dissolution of the fixed liquid T is promoted, resulting in more effective application. An alternative control operation may involve rotating the applying roller 1001 not only in a forward direction shown by an arrow in the figure but also in a reverse direction. Alternatively, a combination of these operations may be performed a plurality of times.

Moreover, unit for raising the temperature of the applying liquid held on the surface of the applying roller 1001 or in the liquid holding space S is effectively provided to raise the temperature of the fixed applying liquid to dissolve the liquid.

Furthermore, by performing the above-described circulating operation to generate a flow of the applying liquid in the liquid holding space S with the fixed liquid T on the applying roller 1001 kept in contact with the applying liquid held in the liquid holding space S (FIG. 28), the re-dissolution of the fixed liquid T can further be promoted, more effectively making the applying liquid even. Moreover, by generating a flow of the applying liquid in the liquid holding space S with the driving of the applying roller 1001 stopped, the fixed liquid can be more reliably re-dissolved. In the present embodiment, during the fixed liquid removing operation, the liquid supply unit allows the applying liquid in the liquid holding member 2001 to flow continuously or intermittently to accelerate the re-dissolution of the fixed liquid T.

Since the liquid supply unit is a negative pressure circulating system, increasing the rotation number of the pump 3007 increases the flow velocity in the liquid channel 3000 and the liquid holding space S, and apparently raises the abutting pressure of the liquid holding member 2009 on the applying roller 1001. This secondarily enhances the effect of scraping the fixed liquid T.

Since the fixed liquid T is thickened or fixed by the evaporation of the moisture from the applying liquid, the degree of thickening and fixation of the fixed liquid T varies depending on the time for which the mechanism is left uncontrolled. That is, an increase in the time for which the mechanism is left uncontrolled increases the degree of thickening and fixation. On the other hand, as described above, in the fixed liquid removing operation, the effect of removal of the fixed liquid is enhanced by reducing the rotation speed of the applying roller 1001 or prolonging the standby time. However, this disadvantageously increases the amount of time until the applying operation can be started. Thus, a short period of the uncontrolled state results in an insignificant degree of fixation and thus enables time required for the attached liquid removing operation to be reduced by appropriately selecting the rotation speed or amount of or the standby time for the applying roller 1001.

That is, acquiring unit for acquiring information on a finish time of the last driving is provided. Then, during the fixed liquid removing operation, elapsed time (the period of the uncontrolled state) from the finish time of the last driving is calculated, and the driving conditions are selected depending on the length of the period of the uncontrolled state. Thus, an efficient fixed liquid removing operation can be performed.

Table 3 shows an example of the period of the uncontrolled state and the driving conditions for the applying roller 1001 (the rotation speed and amount of the applying roller), for the fixed liquid removing operation according to the present embodiment.

In the present embodiment, the finish time of the applying operation is stored in a memory (not shown in the drawings) provided in a part of the control section 4000. Thus, the finish time of the applying operation is updated to the latest value as required. During the fixed liquid removing operation, the finish time of the last applying operation is acquired, and the elapsed time between the finish time to the current time is calculated. Then, based on Table 1, the rotation speed and amount of the applying roller 1001 corresponding to the calculated elapsed time are selected. For example, if the period of the uncontrolled state is relatively short, at least 55 seconds and shorter than 15 minutes, the applying roller 1001 is rotated twice. At this time, during the first rotation, the applying roller 1001 is rotated at a speed of 2.0 inch/sec. Then, during the second rotation, the applying roller 1001 is rotated at a speed of 3.3 inch/sec. In this manner, the applying roller is rotated faster during the second rotation than during the first rotation. This is because a certain amount of fixed liquid is removed during the first rotation. That is, since the fixed liquid can be re-dissolved more quickly during the second rotation than during the first rotation, the applying roller 1001 is rotated faster during the second rotation to reduce the duration of the fixed liquid removing operation. If the period of the uncontrolled state is relatively long, for example, at least 60 hours and shorter than 172 hours, the rotation speed is varied in three stages and the applying roller 1001 is rotated six times in total. That is, the applying roller 1001 is rotated at a speed of 0.8 inch/sec during the first rotation, 3.3 inch/sec during the second to fifth rotations, and 5.3 inch/sec during the sixth rotation.

Thus, by controlling the rotation speed and number of the applying roller depending on the period of the uncontrolled state, the applying roller 1001 is temporally efficiently operated started at an efficient time, with the fixed liquid reliably removed to ensure uniform application. In addition, the re-dissolution of the fixed liquid T can be promoted by increasing the rotation speed of the pump 3007 during the fixed liquid removing operation.

TABLE 3

| Period of uncontrolled state | |
|---|---|
| At least 55 seconds and shorter than 15 minutes | One rotation at 2.0 inch/sec + one rotation at 3.3 inch/sec |
| At least 15 minutes and shorter than 3 hours | One rotation at 0.8 inch/sec + one rotation at 3.3 inch/sec |
| At least 3 hours and shorter than than 60 hours | One rotation at 0.8 inch/sec + one rotation at 3.3 inch/sec + one rotation at 5.3 inch/sec |

TABLE 3-continued

| Period of uncontrolled state | |
|---|---|
| At least 60 hours and shorter than 172 hours | One rotation at 0.8 inch/sec + four rotations at 3.3 inch/sec + one rotation at 5.3 inch/sec |
| At least 172 hours | One rotation at 0.67 inch/sec + four rotations at 2.0 inch/sec + one rotation at 5.3 inch/sec |

(Remaining Applying Liquid Reducing Operation)

To uniformly apply the applying liquid to the applying roller 1001, besides the above-described fixed liquid removing operation, an operation of reducing the amount of the liquid fixed to the applying roller 1001 is effectively performed. Thus, to reduce the amount of the applying liquid remaining in the abutting portion between the applying roller 1001 and the abutting portion of the abutting member 2009, the present embodiment performs an operation (hereinafter referred to as a remaining applying liquid removing operation) of, after completion of the applying operation, reducing the amount of the applying liquid remaining on the surface of the applying roller 1001.

The liquid applying apparatus according to the present embodiment is characterized in that a reduction in the rotation speed of the applying roller 1001 reduces the amount of the applying liquid attached to the applying roller 1001 according to the Newton's law of viscosity. The liquid applying apparatus is also characterized in that an increase in the rotation speed of the pump 3007 increases the value of the negative pressure in the liquid holding space S and thus the apparent abutting pressure of the abutting member 2009 on the applying roller 1001 to reduce the amount of the applying liquid flowing out of the liquid holding member 2001.

Thus, during the remaining applying liquid reducing operation, performed after the completion of the applying operation, the applying roller 1001 is rotated more slowly than during the applying operation, whereas the pump 3007 is driven faster than during the applying operation. Thus, the amount of the applying liquid remaining on the applying roller 1001 is sharply reduced. This reduces the amount of the applying liquid remaining between the applying roller 1001 and the abutting member 2009 and in a nearby area, enabling a reduction in the amount of the fixed liquid T. Thus, the duration of the fixed liquid reducing operation performed before the start of the applying operation can be reduced.

Alternatively, the liquid applying apparatus may be configured to avoid forming a closed space between the liquid holding member 2001 and the applying roller 1001, that is, to avoid the abutment between the abutting member 2009 and the applying roller 1001, depending on the type of the apparatus. In this case, the fixed liquid T is prevented from being formed at the nip portion as shown in FIG. 27. However, the above-described unit is effective because the presence of a contact with the liquid applying member between the liquid level and the liquid applying member results in a thickening phenomenon.

(Finishing Step (Including the Collecting Step))

Once the operation of applying the liquid to the applying medium has been performed as described above, the control section 4000 determines whether or not to finish the applying step (step S6). If the applying step is not to be finished, the control section 4000 returns to step S5 to repeat the applying operation until the applying step is executed on the all the parts of the applying medium to which the liquid needs to be applied. When the applying step is finished, the applying roller 1001 is stopped (step S7). Moreover, the driving of the pump 3007 is stopped (step S8). Subsequently, the control section 4000 shifts to step S2 to repeat the operations in step S2 to step S8 if an application start instruction is input. If the application start instruction is not input, a postprocess is executed such as a collecting operation of collecting the applying liquid from the liquid holding space S and liquid channels (step S9). Then, the applying process is finished.

The collecting operation is performed by driving the pump 3007 for a given time with the shut-off valves set according to the combination of the open and closed states for the "collection" state. This combination of the open and closed states allows the buffer tank 3002 to communicate with the liquid applying space S through the second channel, while allowing the first channel to communicate with a communication port 3008 that is an air communication port, for the liquid applying space S. This allows the air to be supplied to the tube 3102, liquid applying space S, tube 3103, tube 3104, pump 3007, and tube 3105, all of which constitute the second channel. The applying liquid filled in the space is thus collected in the buffer tank 3002. The collecting operation enables a sharp reduction of evaporation of the applying liquid from the liquid holding space S.

After the collecting operation, the shut-off valves are set according to the combination of the open and closed states for the "uncontrolles" state. This combination of the open and closed states causes the replacement tank 3001, buffer tank 3002, and liquid applying space S to be shut off from one another. Even if the posture of the apparatus is thereafter tilted during movement, transportation, or the like, the applying liquid is prevented from leaking to the exterior. Moreover, the shut-off valves enable complete prevention or reduction of movement of the applying liquid between the tanks or outflow the applying liquid to the exterior.

2. Second Embodiment

In the first embodiment, the liquid sensor Y001 is mounted in the second channel in the liquid channel 3000. However, the present invention is applicable to a liquid applying apparatus that avoids installation of the liquid sensor Y001. That is, the present invention is applicable to the configuration shown in FIG. 1 and in which the liquid sensor Y001 is omitted, with the tubes 3103 and 3013*a* coupled together or integrally formed.

Figure 16:
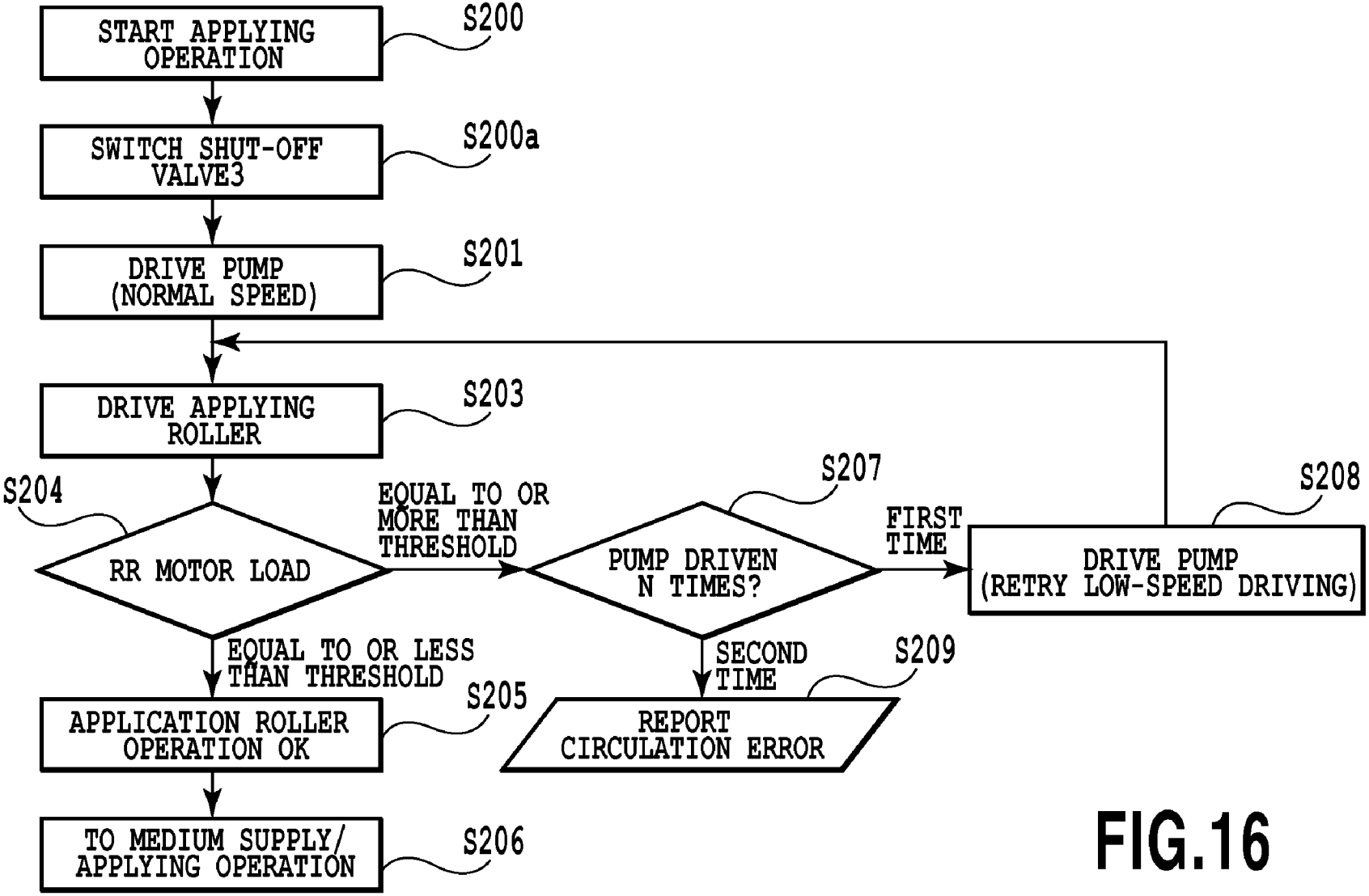
FIG. 16 is a flowchart showing the operation of the filling step according to another embodiment of the present invention.

FIG. 16 is a flowchart showing the operation of a filling step according to the second embodiment of the present invention. As shown in the figure, the second embodiment is different from the above-described first embodiment in the filling step.

That is, in the filling step, the combination of the open and closed states of the shut-off valves is set for the "circulation" state (S200*a*). Thus, the liquid applying space S communicates with the buffer tank 3002 via the first and second channels. The pump 3007 is thereafter driven by a predetermined amount (S201). The applying liquid is thus supplied to the liquid applying space S and the second channel in this order. This step allows the applying liquid to be supplied to the applying roller 1001, enabling the applying liquid to be applied to the applying medium (S205).

However, even when the pump 3007 is driven by a predetermined amount, the applying liquid may infrequently fail to be sufficiently supplied to the applying roller 1001. Possible causes are, for example, as follows.

(1) A defect in the pump or the circulating path.

(2) The applying liquid is thickened to reduce the flow speed.

In view of these cases, in the filling step according to the present embodiment, the control operation is performed according to a procedure shown in a flowchart in FIG. 16.

First, the pump 3007 is driven by a predetermined amount (S203). Then, the roller driving motor 1004 is driven to rotate the applying roller 1001 (S203). The current driving load is detected based on, for example, the driving current for the roller driving motor 1004 or the duty ratio of the PWM control of the roller driving motor 1004 (S204). If the load is equal to or less than a predetermined threshold, the control section 4000 determines that the applying liquid is present in the liquid applying space S (S205). The control section 4000 then performs the subsequent part of the applying operation (S206).

If in step S204, the load is equal to or more than the threshold, the control section 4000 determines that no applying liquid is present in the liquid applying section S. The control section 4000 thus drives the pump 3007 again in order to fill the applying liquid into the liquid applying space S (S208). The control section 400 thereafter drives the applying roller again (S203), and detects the current driving load in the same manner as that described above (S204). If the load is equal to or less than the threshold, the control section 4000 determines that the applying liquid is present in the liquid applying space S (S205). The control section 4000 then proceeds to the subsequent part of the applying operation (S206).

If the driving load detected when the applying roller is driven again (S203) is determined again to be equal to or more than the threshold, the control section 4000 determines that a certain error is occurring in the pump 3007 or the fluid channel 3000, the control section 400 performs a reporting operation after step S207 (S209).

In the above-described embodiments, both the buffer tank (storing unit) 3002 and the replacement tank (second storing unit) 3001 are provided by way of example. However, the present invention is applicable to a liquid applying apparatus with single storing unit.

Furthermore, in the above-described embodiments, the load on the roller driving motor 1004 is detected to determine the viscosity of the applying liquid, the condition of supply of the liquid to the liquid holding space S, whether or not the liquid in the pump is thickened, and the like. However, whether or not the liquid is thickened in the pump can be determined by detecting a load on the pump driving motor 4009. That is, thickening or solidification of the liquid in the pump 3007 increases the driving load on the pump driving motor 4009 to change the driving current for the pump driving motor 4009 or the duty ratio of the PWM control of the pump driving motor 4009. Thus, when the driving current for the pump driving motor 4009 or the duty ratio of the PWM control of the pump driving motor 4009 is detected, the control section 4000 can detect the driving load on the pump driving motor based on the result of the detection. That is, the control section 4000 can be allowed to function as second load detecting unit for detecting the load on the pump driving motor.

If the driving load on the pump driving motor is determined to be equal to or more than the given threshold, the pump is operated at a pump driving speed lower than that set for the first filling operation. Thus, an operation of re-supplying the applying liquid to the liquid holding space S is performed. This is to reduce the flow velocity to allow the thickened liquid in the pump to flow easily.

Moreover, after the re-supply operation, the load on the roller driving motor 1004 is detected to check the condition of supply of the liquid to the liquid holding space S. If the driving load on the roller driving motor is equal to or less than the threshold, the control section 4000 determines that the liquid has been supplied normally and performs the applying operation. If the driving load on the roller driving motor is more than the threshold, the control section determines that the supply of the liquid is improper, and reports this error through display unit or the like. The control section 4000 stops the driving of the appropriate sections including the pump driving motor 4009 and the roller driving motor 1004. Thus, the applying roller can be prevented from disadvantageously continuing to rotate without feeding the applying liquid into the applying space S, owing to an error in the supply channel, the thickened applying liquid, or the like.

3. Embodiments of the Ink Jet Printing Apparatus 3.1. General Configuration

Figure 17:
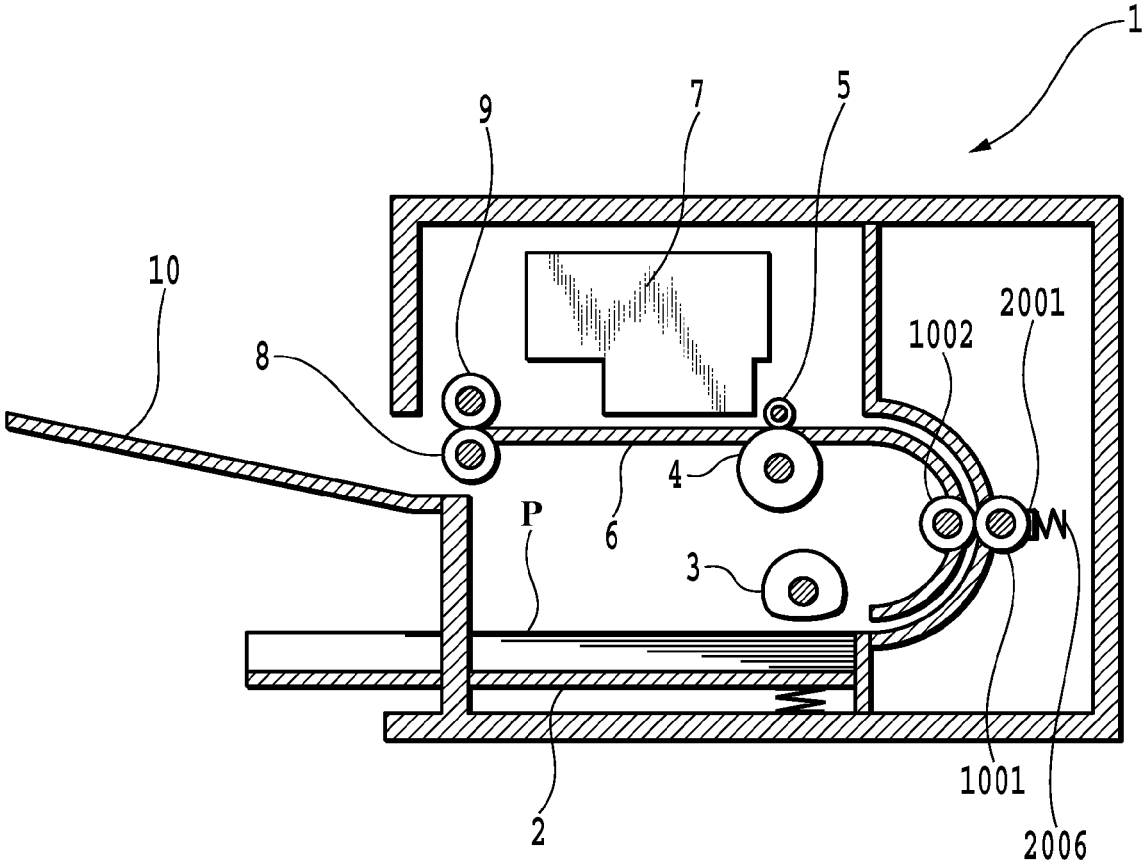
FIG. 17 is a vertical side view showing a general configuration of an ink jet printing apparatus according to an embodiment of the present invention.

FIG. 17 is a diagram generally showing the configuration of an ink jet printing apparatus 1 comprising an applying mechanism having almost the same configuration as that of the above liquid applying apparatus.

The ink jet printing apparatus 1 is provided with a feeding tray 2 on which a plurality of print media P are stacked. A semicircular separating roller 3 separates each print medium P from the others stacked on the feeding tray and then feeds it to a conveying path. The applying roller 1001 and the counter roller 1002 are arranged in the conveying path; the applying roller 1001 and the counter roller 1002 constitute the liquid applying mechanism. The print medium P fed from the feeding tray 2 is then fed to between the rollers 1001 and 1002. The applying roller 1001 is rotated clockwise in FIG. 17 by the rotation of a roller driving motor. The applying roller 1001 applies the application liquid to a print surface of the print medium P while conveying the print medium P. The print medium P to which the application liquid has been applied is fed to between a conveying roller 4 and a pinch roller 5. Then, the conveying roller 4 is rotated counterclockwise in the figure to convey the print medium P on a platen 6. The print medium P then moves to a position opposite to a print head 7 constituting printing unit. The print head 7 is of an ink jet type in which a predetermined number of nozzles for ink ejection are disposed. While the print head 7 is being scanned in a direction perpendicular to the sheet of the drawing, printing is carried out by ejecting ink droplets from the nozzles to the print surface of the print medium P in accordance with print data. An image is formed on the print medium by alternately repeating a printing operation and a conveying operation performed by the conveying roller 4 to convey the print medium by a predetermined amount. Simultaneously with this image forming operation, the print medium P is sandwiched between a sheet discharging roller 8 and a sheet discharging spur 9 both provided downstream of the scan area of the print head in the conveying path for the print medium. The print medium P is then discharged onto a sheet discharging tray 10 by the rotation of the sheet discharging roller 8.

As this ink jet printing apparatus, what is called a full line type can be constructed in which an elongate print head having nozzles from which inks are ejected and which are disposed over the maximum width of the print medium is used to perform a printing operation.

The application liquid used in the present embodiment is a treatment liquid that facilitates the coagulation of pigments when inks composed of the pigments as color materials are used for printing. In the present embodiment, the treatment liquid is used as an application liquid to react with the pigments, which are the color materials of the inks ejected to the print medium to which the treatment liquid has been applied. This facilitates the coagulation of the pigments. The facilitation of the coagulation of the pigments improves the printing density. Moreover, it is possible to suppress or prevent bleeding. The application liquid used in the ink jet printing apparatus is not limited to the above example.

Figure 18:
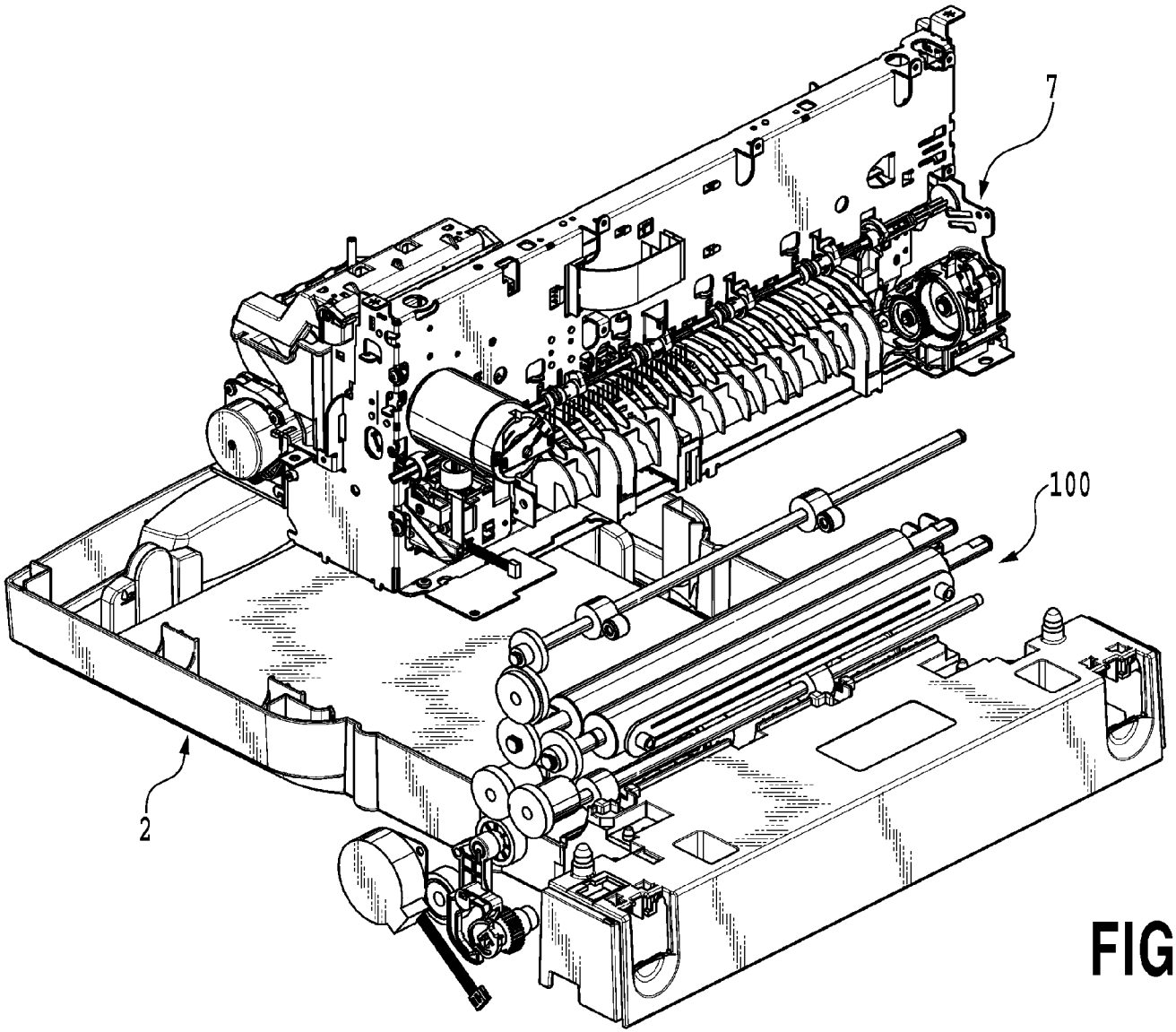
FIG. 18 is a perspective view showing an essential part of the ink jet printing apparatus shown in FIG. 17.

FIG. 18 is a perspective view showing an essential part of the above ink jet printing apparatus. As shown in FIG. 18, an applying mechanism 100 is provided above one end of the feeding tray 2. A printing mechanism comprising the print head 7 and the like is provided above the applying mechanism 100 and above a central portion of the feeding tray 2.

Figure 19:
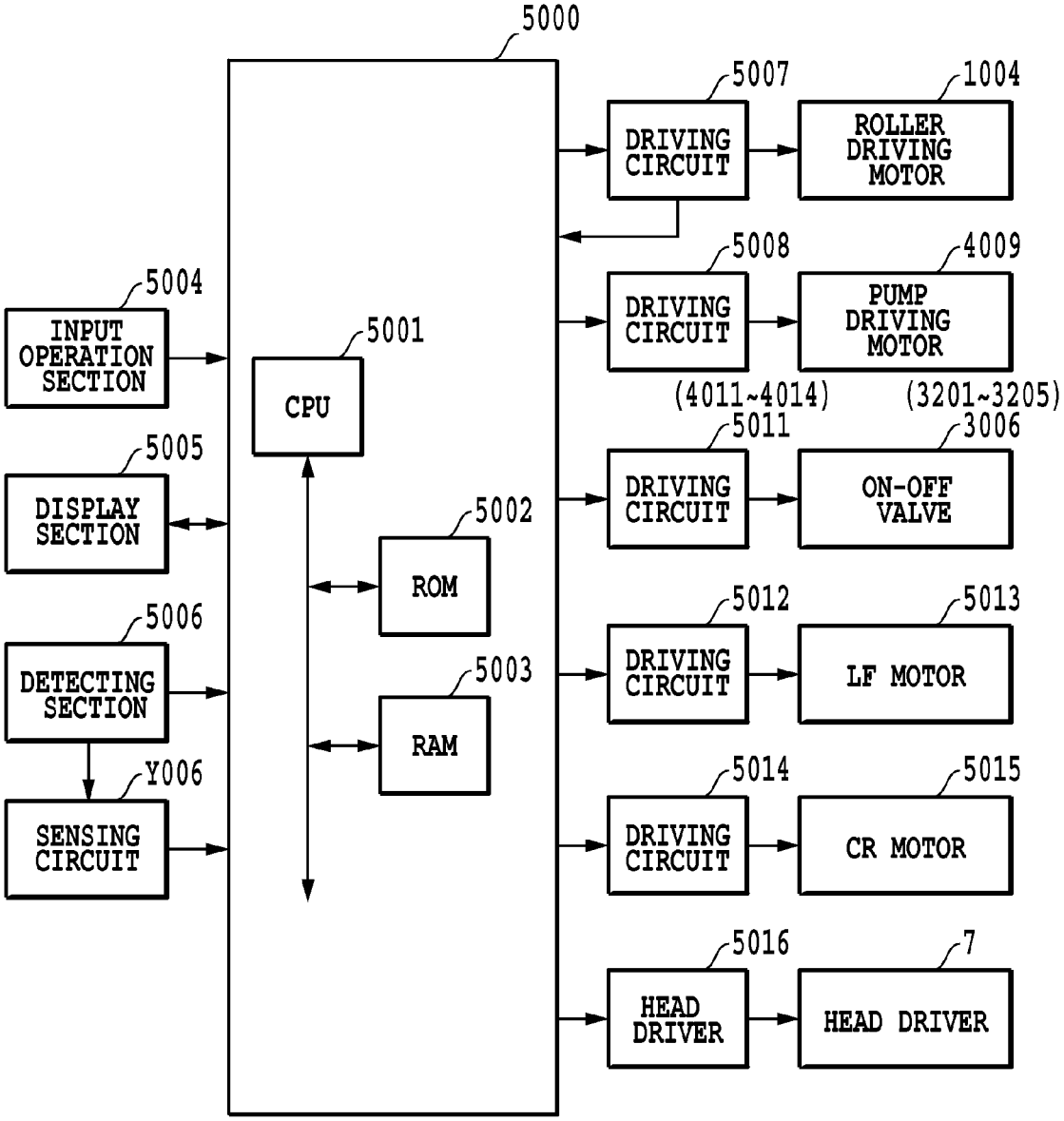
FIG. 19 is a block diagram showing a general configuration of a control system in the ink jet printing apparatus shown in FIG. 17.

FIG. 19 is a block diagram showing a control arrangement for the above ink jet printing apparatus. In FIG. 19, the roller driving motor 1004, the pump driving motor 4009, and the actuator 3005 for the air communicating valve, all of which are elements of the liquid applying mechanism, are similar to those described for the liquid applying apparatus.

3.2. Control System

In accordance with a program of a process procedure described later in FIG. 23, a CPU 5001 controls the driving of the elements of the applying mechanism. The CPU 5001 also controls the driving of an LF motor 5013, a CR motor 5015, and the print head 7 which relate to the printing mechanism, via driving circuits 5012 and 5014 and a head driver 5016. That is, driving by the LF motor 5013 rotates the conveying roller 4. Driving by the CR motor moves a carriage on which the print head 7 is mounted. Moreover, the CPU 5001 performs control such that inks are ejected through the nozzles in the print head.

3.3. Sequence of a Printing Operation

Figure 20:
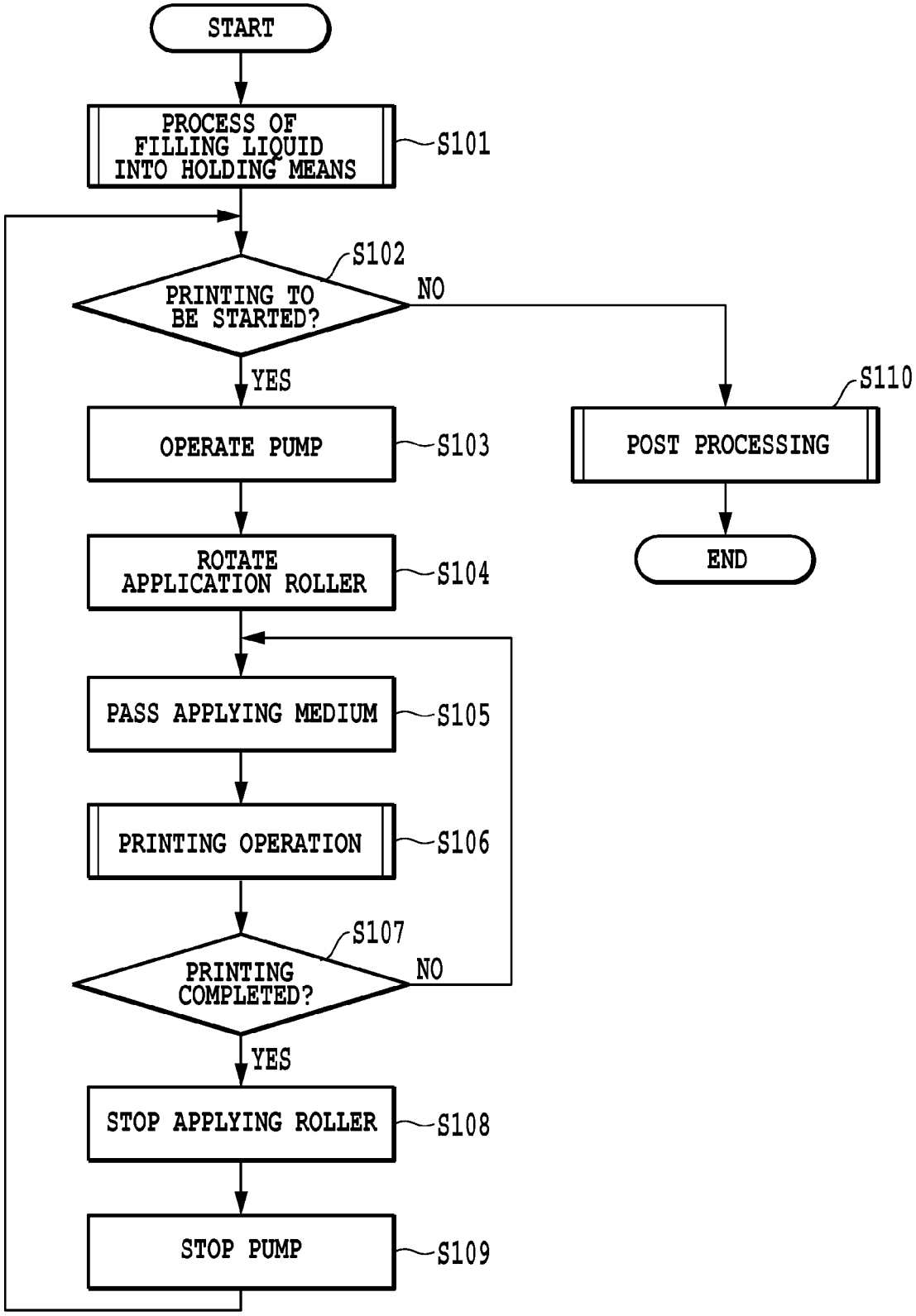
FIG. 20 is a flowchart showing a procedure of liquid application and an associated printing operation in the ink jet printing apparatus according to the present embodiment.

FIG. 20 is a flowchart showing the procedure of liquid application and an accompanying printing operation in the ink jet printing apparatus according to the present embodiment. In FIG. 20, the processing during steps S101, during S103 to S108, and during S110 to S113 is similar to that during step S1, during steps S3 to S7, and during steps S9 to S11, all the steps being shown in FIG. 14.

As shown in FIG. 23, in the present embodiment, a print start instruction is given (step S102). Then, a series of liquid applying operations such as pump activation are performed (steps S103 to S105).

After this applying step, a printing operation is performed on a print medium having the application liquid applied to desired parts of the medium (step S106). That is, the print head 7 is scanned over the print medium P conveyed by the conveying roller 4 by a predetermined amount at a time. During the scan, inks are ejected from the nozzles in accordance with print data so as to adhere to the print medium to form dots. The adhering inks react with the application liquid, thus improving the density and preventing bleeding. The conveyance of the print medium and the scanning of the print head are repeated to print the print medium P. The finished print medium is discharged onto the sheet discharging tray 10. When the apparatus determines in step S107 that the printing has been finished, the processing in step S108 and the subsequent steps is executed to finish the present process.

In the present embodiment, as the liquid is applied to the print medium, printing is sequentially executed on parts of the print medium to which the liquid has already been applied. That is, the conveying path from the conveying roller to the print head is shorter than the print medium, and when a part of the print medium to which the liquid has already been applied reaches the scan area of the print head, the applying mechanism applies the liquid to another part of the print medium. Every time the print medium is conveyed by a predetermined amount, liquid application and printing are sequentially executed on different parts of the print medium. However, in an alternative form of application of the present invention, printing may be carried out after one print medium has been completely applied the application liquid.

Further, in the printing apparatus of the present invention, the degree of whiteness of the medium can be improved by using a liquid containing a fluorescent whitening agent as an application liquid. The printing unit after the liquid application is not limited to the ink jet printing system. Effects can be produced using a printing system such as a thermal transfer system or an electrophotographic system. In a silver salt-based printing apparatus, a photosensitive agent as the application liquid may be applied before printing.

Furthermore, the printing apparatus according to the present invention can improve the whiteness of the medium by allowing the liquid applying mechanism to apply a liquid containing a fluorescent whitening agent to the medium. In this case, the printing unit used after the application of the liquid is not limited to the one based on the ink jet printing method. Effects similar to those of the ink jet printing method can be exerted by a printing method such as a thermal transfer method or an electrophotographic method.

Alternatively, a silver photographic method may be used to apply a liquid containing a fluorescent whitening agent that improves the whiteness of the medium or to apply a photosensitive agent before printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-013068, filed Jan. 23, 2008, which is hereby incorporated by reference herein in its entirety.

What is claimed is:

1. A liquid applying apparatus comprising:

an applying mechanism comprising an applying roller and a liquid holding portion, configured to apply a liquid to a medium by rotation of the applying roller;

a driving unit comprising a motor that drives the applying roller;

a liquid supplying unit comprising a pump configured to supply the liquid to the liquid holding portion, a detecting unit that detects a driving load on the motor; and a control unit configured to control the motor and the pump such that, after the liquid supplying unit has supplied the liquid to the liquid holding portion, the detecting unit detects the driving load while the motor is driven, and if the detected driving load is more than a threshold, the liquid supplying unit resupplies the liquid to the liquid holding portion.

2. The liquid applying apparatus according to claim 1, wherein the detecting unit detects the driving load based on a value of a driving current for the motor.

3. The liquid applying apparatus according to claim 1, wherein the detecting unit detects the driving load based on a duty ratio of voltage pulses in a Pulse Width Modulation control performed on the motor.

4. The liquid applying apparatus according to claim 1, wherein the resupply operation of the liquid supplying unit supplies the liquid at a speed different from that at which the liquid is supplied during the liquid supply operation performed before the resupply operation.

5. The liquid applying apparatus according to claim 1, wherein if the driving load detected by the detecting unit is more than the threshold after the resupplying operation, the control unit stops driving of at least the driving unit.

6. The liquid applying apparatus according to claim 1, wherein the liquid supplying unit further comprises a liquid tank, a liquid channel through which the liquid holding portion and the liquid tank communicate with each other, and a liquid sensing unit provided in the liquid channel on a downstream side of the liquid holding portion, and the control unit is further configured to control such that, if the liquid sensing unit determines that the liquid is present after the liquid supplying unit has supplied the liquid to the liquid holding portion, the detecting unit skips the detection operation and the liquid supplying unit skips the resupplying operation.

7. The liquid applying apparatus according to claim 1, further comprising a load detecting unit that detects a driving load on the liquid supplying unit.

8. The liquid applying apparatus according to claim 1, further comprising a printing unit that ejects ink from a print head to a medium with the liquid applied thereto to print an image on the medium.

* * * * *